US009926520B2

(12) United States Patent
Panandiker et al.

(10) Patent No.: US 9,926,520 B2
(45) Date of Patent: Mar. 27, 2018

(54) METHOD OF TREATING A FABRIC BY WASHING WITH A DETERGENT COMPRISING AN ANIONIC/NONIONIC SURFACTANT SYSTEM AND SILICONE

(71) Applicant: The Procter & Gamble Company, Cincinnati, OH (US)

(72) Inventors: Rajan Keshav Panandiker, West Chester, OH (US); Mark Robert Sivik, Mason, OH (US); Renae Dianna Fossum, Middletown, OH (US); Susanne Birkel, Darmstadt (DE); Nicholas David Vetter, Cleves, OH (US); Heather Anne Doria, Ross Township, OH (US); Carola Barrera, West Chester, OH (US); Bernardo Aguilera-Mercado, Kenwood, OH (US); Aaron Flores-Figueroa, Mannheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 5 days.

(21) Appl. No.: 15/442,726

(22) Filed: Feb. 27, 2017

(65) Prior Publication Data

US 2017/0166844 A1 Jun. 15, 2017

Related U.S. Application Data

(63) Continuation of application No. 14/834,466, filed on Aug. 25, 2015, now Pat. No. 9,617,501.

(60) Provisional application No. 62/042,372, filed on Aug. 27, 2014.

(51) Int. Cl.

| | |
|---|---|
| ***C11D 1/12*** | (2006.01) |
| ***C11D 1/22*** | (2006.01) |
| ***C11D 1/29*** | (2006.01) |
| ***C11D 1/62*** | (2006.01) |
| ***C11D 1/65*** | (2006.01) |
| ***C11D 1/82*** | (2006.01) |
| ***C11D 1/83*** | (2006.01) |
| ***C11D 9/36*** | (2006.01) |
| ***C11D 11/00*** | (2006.01) |
| ***C11D 3/00*** | (2006.01) |
| ***C11D 3/37*** | (2006.01) |
| ***C11D 17/04*** | (2006.01) |
| ***C11D 3/50*** | (2006.01) |
| ***C11D 17/00*** | (2006.01) |

(52) U.S. Cl.

CPC ..... *C11D 11/0017* (2013.01); *C11D 1/22* (2013.01); *C11D 1/29* (2013.01); *C11D 1/62* (2013.01); *C11D 1/83* (2013.01); *C11D 3/001* (2013.01); *C11D 3/373* (2013.01); *C11D 3/3769* (2013.01); *C11D 3/505* (2013.01); *C11D 17/0039* (2013.01); *C11D 17/042* (2013.01); *C11D 17/045* (2013.01)

(58) Field of Classification Search

CPC .... C11D 1/12; C11D 1/22; C11D 1/29; C11D 1/62; C11D 1/65; C11D 1/82; C11D 1/83; C11D 3/001; C11D 3/162; C11D 3/373; C11D 3/3738; C11D 3/3742; C11D 3/505; C11D 9/225; C11D 9/36; C11D 9/442; C11D 11/0017

See application file for complete search history.

(56) References Cited

U.S. PATENT DOCUMENTS

| | | | | |
|---|---|---|---|---|
| 5,051,196 | A | 9/1991 | Gizaw | |
| 5,302,322 | A | 4/1994 | Birtwistle | |
| 6,949,498 | B2 | 9/2005 | Murphy et al. | |
| 7,018,973 | B2 * | 3/2006 | Katz | C11D 1/58 510/466 |
| 7,202,206 | B2 | 4/2007 | Depoot et al. | |
| 7,244,697 | B2 | 7/2007 | Terada | |
| 7,273,837 | B2 | 9/2007 | Boutique et al. | |
| 7,326,676 | B2 | 2/2008 | Delplancke et al. | |
| 7,439,217 | B2 | 10/2008 | Boutique et al. | |
| 7,569,529 | B2 | 8/2009 | Frankenbach | |
| 7,754,671 | B2 | 7/2010 | Lin et al. | |
| 7,772,175 | B2 | 8/2010 | Panandiker et al. | |
| 7,994,112 | B2 | 8/2011 | Vanpachtenbeke et al. | |
| 8,207,105 | B2 | 6/2012 | Panandiker et al. | |
| 8,263,544 | B2 | 9/2012 | Panandiker et al. | |
| 8,450,263 | B2 | 5/2013 | Panandiker et al. | |
| 8,541,352 | B2 | 9/2013 | Randall et al. | |
| 8,546,314 | B2 | 10/2013 | Randall et al. | |
| 8,765,659 | B2 | 7/2014 | Gizaw et al. | |
| 9,186,642 | B2 | 11/2015 | Dihora et al. | |

(Continued)

FOREIGN PATENT DOCUMENTS

| | | |
|---|---|---|
| WO | WO 2005/087907 A1 | 9/2005 |
| WO | WO 2009/095823 A1 | 8/2009 |

OTHER PUBLICATIONS

PCT Search Report for International application No. PCT/US2015/046631, dated Dec. 3, 2015, containing 13 pages.

U.S. Appl. No. 14/834,459, filed Aug. 25, 2015, Rajan Keshav Panandiker.

U.S. Appl. No. 14/834,460, filed Aug. 25, 2015, Rajan Keshav Panandiker.

U.S. Appl. No. 14/834,463, filed Aug. 25, 2015, Rajan Keshav Panandiker.

U.S. Appl. No. 14/834,464, filed Aug. 25, 2015, Renae Dianna Fossum.

U.S. Appl. No. 14/834,468, filed Aug. 25, 2015, Rajan Keshav Panandiker.

U.S. Appl. No. 14/864,921, filed Sep. 25, 2015, Renae Dianna Fossum.

*Primary Examiner* — Charles Boyer

(74) *Attorney, Agent, or Firm* — Gregory S. Darley-Emerson; Leonard W. Lewis

(57) ABSTRACT

A method of treating a fabric, where the method includes a washing step and a rinsing step. A multi-component fabric treatment system, wherein the system includes a first component comprising a detergent composition, and where the system further includes a second component comprising a softener composition.

20 Claims, No Drawings

(56) References Cited

U.S. PATENT DOCUMENTS

2002/0077265 A1 6/2002 Buzzacarini et al.
2002/0137657 A1 9/2002 Lant et al.
2008/0118568 A1 5/2008 Smets et al.
2008/0229519 A1* 9/2008 Depoot ..... C11D 3/227 8/401
2008/0234165 A1 9/2008 Panandiker et al.
2008/0242584 A1 10/2008 Wahl et al.
2010/0152306 A1 6/2010 Warr
2011/0065625 A1 3/2011 Boutique
2011/0123582 A1 5/2011 Smets
2011/0177994 A1 7/2011 Wahl et al.
2012/0077725 A1 3/2012 Wang et al.
2012/0083438 A1 4/2012 Panandiker et al.
2012/0137448 A1 6/2012 Panandiker et al.
2012/0309663 A1 12/2012 Panandiker et al.
2013/0118531 A1 5/2013 Dobrawa et al.
2013/0123166 A1 5/2013 Gizaw
2013/0232700 A1 9/2013 Smith et al.
2014/0017307 A1 1/2014 Marzouk
2014/0018282 A1 1/2014 Wieland
2014/0020188 A1 1/2014 Gizaw et al.
2014/0030205 A1 1/2014 Panandiker et al.
2014/0094397 A1 4/2014 Guida
2014/0187466 A1 7/2014 Lin
2014/0243253 A1 8/2014 Schmiedel
2014/0296127 A1 10/2014 Hulskotter et al.
2015/0017700 A1 1/2015 Estell
2015/0030643 A1 1/2015 Gartstein et al.
2015/0030644 A1 1/2015 Oh et al.
2015/0071977 A1 3/2015 Dihora et al.
2015/0093526 A1 4/2015 Denome
2016/0060574 A1 3/2016 Panandiker et al.

* cited by examiner

METHOD OF TREATING A FABRIC BY WASHING WITH A DETERGENT COMPRISING AN ANIONIC/NONIONIC SURFACTANT SYSTEM AND SILICONE

FIELD OF THE INVENTION

The present disclosure relates to a method of treating a fabric. In some aspects, the present disclosure relates to a method of treating a fabric, where the method comprises a washing step and a rinsing step. In some aspects, the present disclosure relates to a multi-component fabric treatment system, where the system comprises a first component comprising a detergent composition, and where the system further comprises a second component comprising a fabric softener composition.

BACKGROUND OF THE INVENTION

Consumers desire laundry compositions that leave their clothes looking clean and feeling soft. To meet this need, detergent manufacturers have formulated certain laundry detergents with fabric softening actives (FSAs), such as silicones. Unfortunately, in many of these 2-in1 detergents that deliver cleaning and softening in a single product, much of the silicone fails to deposit on the fabric during the wash cycle, and is instead wastefully carried away by the rinse water. Therefore, there is a need to improve the deposition efficiency of silicone delivered by detergents through the wash.

The applicants have found that silicone deposition efficiency can be surprisingly improved using a method of treating fabrics with a wash-added detergent comprising silicone followed by a rinse-added softener composition. Furthermore, particular attention to the combination of surfactants used in the wash-added detergent composition can improve silicone deposition further when combined with a rinse-added composition. Additionally, methods of using certain silicone-containing detergents followed by silicone-containing softener compositions, as described in the present disclosure, provide unexpected and synergistic silicone deposition benefits.

SUMMARY OF THE INVENTION

The present disclosure relates to methods of treating a fabric, where the methods comprise a washing step and a rinsing step.

In some aspects, the present disclosure relates to a method of treating a fabric, where the method comprises: a washing step, where the washing step comprises contacting the fabric with an effective amount of a detergent composition, thereby forming a washed fabric, where the detergent composition comprises a surfactant system and a silicone, where the surfactant system comprises anionic surfactant and nonionic surfactant in a surfactant ratio, preferably of from about 1.1:1 to about 4:1; followed by a rinsing step, where the washed fabric is contacted with an effective amount of a softener composition, thereby forming a treated fabric, where the softener composition comprises a fabric softening active (FSA).

In some aspects, the present disclosure relates to a multi-component fabric treatment system, where the system comprises a first component comprising a detergent composition as described herein, and where the system further comprises a second component comprising a softener composition as described herein.

DETAILED DESCRIPTION OF THE INVENTION

The present disclosure relates to a method of treating a fabric, where the method comprises a washing step and a rinsing step. It has been surprisingly found that a fabric softener composition added in the rinsing step can positively impact the deposition efficiency onto fabric of silicone added in the washing step as part of particular detergent compositions. More specifically, in some aspects, it has been found that washing a fabric with a detergent composition comprising anionic surfactant and nonionic surfactant in a surfactant ratio of from about 1.1:1 to about 4:1 and a silicone and then adding a fabric softener composition to the rinse provides good silicone deposition benefits. Furthermore, in some aspects, certain other detergent adjuncts may improve cleaning, deposition, softness, and/or freshness benefits. These steps and elements are discussed in more detail below.

Definitions

As used herein, the term "molecular weight" refers to the weight average molecular weight of the polymer chains in a polymer composition. Further, as used herein, the "weight average molecular weight" ("Mw") is calculated using the equation:

$$Mw=(\Sigma i\ Ni\ Mi^2)/(\Sigma i\ Ni\ Mi)$$

where Ni is the number of molecules having a molecular weight Mi. The weight average molecular weight must be measured by the method described in the Test Methods section.

As used herein, the term "effective amount" of a composition means an amount sufficient to confer the intended benefit of the composition under conditions of intended use.

As used herein "mol %" refers to the relative molar percentage of a particular monomeric structural unit in a polymer. It is understood that within the meaning of the present disclosure, the relative molar percentages of all monomeric structural units that are present in the cationic polymer add up to 100 mol %.

As used herein, the term "derived from" refers to monomeric structural unit in a polymer that can be made from a compound or any derivative of such compound, i.e., with one or more substituents. Preferably, such structural unit is made directly from the compound in issue. For example, the term "structural unit derived from (meth)acrylamide" refers to monomeric structural unit in a polymer that can be made from (meth)acrylamide, or any derivative thereof with one or more substituents. Preferably, such structural unit is made directly from (meth)acrylamide. As used herein, the term "(meth)acrylamide" refers to either acrylamide ("Aam") or methacrylamide; (meth)acrylamide is abbreviated herein as "(M)AAm." For another example, the term "structural unit derived from a diallyl dimethyl ammonium salt" refers to monomeric structural unit in a polymer that can be made directly from a diallyl dimethyl ammonium salt (DADMAS), or any derivative thereof with one or more substituents. Preferably, such structural unit is made directly from such diallyl dimethyl ammonium salt. For yet another example, the term "structural unit derived from acrylic acid" refers to monomeric structural unit in a polymer that can be made from acrylic acid (AA), or any derivative thereof with one or more substituents. Preferably, such structural unit is made directly from acrylic acid.

The term "ammonium salt" or "ammonium salts" as used herein refers to various compounds selected from the group consisting of ammonium chloride, ammonium fluoride, ammonium bromide, ammonium iodine, ammonium bisulfate, ammonium alkyl sulfate, ammonium dihydrogen phosphate, ammonium hydrogen alkyl phosphate, ammonium dialkyl phosphate, and the like. For example, the diallyl dimethyl ammonium salts as described herein include, but are not limited to: diallyl dimethyl ammonium chloride (DADMAC), diallyl dimethyl ammonium fluoride, diallyl dimethyl ammonium bromide, diallyl dimethyl ammonium iodine, diallyl dimethyl ammonium bisulfate, diallyl dimethyl ammonium alkyl sulfate, diallyl dimethyl ammonium dihydrogen phosphate, diallyl dimethyl ammonium hydrogen alkyl phosphate, diallyl dimethyl ammonium dialkyl phosphate, and combinations thereof. Preferably but not necessarily, the ammonium salt is ammonium chloride.

As used herein, articles such as "a" and "an" when used in a claim, are understood to mean one or more of what is claimed or described.

As used herein, the terms "comprising," "comprises," "include", "includes" and "including" are meant to be non-limiting. The term "consisting of" or "consisting essentially of" are meant to be limiting, i.e., excluding any components or ingredients that are not specifically listed except when they are present as impurities.

The term "substantially free of" as used herein refers to either the complete absence of an ingredient or a minimal amount thereof merely as impurity or unintended byproduct of another ingredient. In some aspects, a composition that is "substantially free" of a component means that the composition comprises less than 0.1%, or less than 0.01%, or even 0%, by weight of the composition, of the component.

As used herein, "substantially removed" means that at least about 50%, or at least about 70%, or at least about 75%, or at least about 80%, or at least about 85%, or at least about 90% of a substance, typically an aqueous liquor, is removed from the system, for example by draining the wash liquor from an automatic wash machine or by emptying a hand-wash bucket. It is understood that some residual substance, e.g. water, may remain on the fabric, keeping them wet or damp.

As used herein, the term "solid" includes granular, powder, bar, bead, and tablet product forms.

As used herein, the term "fluid" includes liquid, gel, paste, and gas product forms.

As used herein, the term "liquid" refers to a fluid having a liquid having a viscosity of from about 1 to about 2000 mPa*s at 25° C. and a shear rate of 20 $sec^{-1}$. In some embodiments, the viscosity of the liquid may be in the range of from about 200 to about 1000 mPa*s at 25° C. at a shear rate of 20 $sec^{-1}$. In some embodiments, the viscosity of the liquid may be in the range of from about 200 to about 500 mPa*s at 25° C. at a shear rate of 20 $sec^{-1}$.

As used herein, the term "cationic polymer" means a polymer having a net cationic charge. Furthermore, it is understood that the cationic polymers described herein are typically synthesized according to known methods from polymer-forming monomers (e.g., (meth)acrylamide monomers, DADMAS monomers, etc.). As used herein, the resulting polymer is considered the "polymerized portion" of the cationic polymer. However, after the synthesis reaction is complete, a portion of the polymer-forming monomers may remain unreacted and/or may form oligomers. As used herein, the unreacted monomers and oligomers are considered the "unpolymerized portion" of the cationic polymer. As used herein, the term "cationic polymer" includes both the polymerized portion and the unpolymerized portion unless stated otherwise. In some aspects the cationic polymer, comprises an unpolymerized portion of the cationic polymer. In some aspects, the cationic polymer comprises less than about 50%, or less than about 35%, or less than about 20%, or less than about 15%, or less than about 10%, or less than about 5%, or less than about 2%, by weight of the cationic polymer, of an unpolymerized portion. The unpolymerized portion may comprise polymer-forming monomers, cationic polymer-forming monomers, or DADMAC monomers, and/or oligomers thereof. In some aspects, the cationic polymer comprises more than about 50%, or more than about 65%, or more than about 80%, or more than about 85%, or more than about 90%, or more than about 95%, or more than about 98%, by weight of the cationic polymer, of a polymerized portion. Furthermore, it is understood that the polymer-forming monomers, once polymerized, may be modified to form polymerized repeat/structural units. For example, polymerized vinyl acetate may be hydrolyzed to form vinyl alcohol.

As used herein, "charge density" refers to the net charge density of the polymer itself and may be different from the monomer feedstock. Charge density for a homopolymer may be calculated by dividing the number of net charges per repeating (structural) unit by the molecular weight of the repeating unit. The positive charges may be located on the backbone of the polymers and/or the side chains of polymers. For some polymers, for example those with amine structural units, the charge density depends on the pH of the carrier. For these polymers, charge density is calculated based on the charge of the monomer at pH of 7. "CCD" refers to cationic charge density, and "ACD" refers to anionic charge density. Typically, the charge is determined with respect to the polymerized structural unit, not necessarily the parent monomer.

As used herein, the term "Cationic Charge Density" (CCD) means the amount of net positive charge present per gram of the polymer. Cationic charge density (in units of equivalents of charge per gram of polymer) may be calculated according to the following equation:

$$CCD = \frac{(Qc \times \text{mol } \%\ c) - (Qa \times \text{mol } \%\ a)}{(\text{mol } \%\ c \times MWc) + (\text{mol } \%\ n \times MWn) + (\text{mol } \%\ a \times MWa)}$$

where: Qc, Qn, and Qa are the molar equivalents of charge of the cationic, nonionic, and anionic repeat units (if any), respectively; Mol % c, mol % n, and mol % a are the molar ratios of the cationic, nonionic, and anionic repeat units (if any), respectively; and MWc, MWn, and MWa are the molecular weights of the cationic, nonionic, and anionic repeat units (if any), respectively. To convert equivalents of charge per gram to milliequivalents of charge per gram (meq/g), multiply equivalents by 1000. If a polymer comprises multiple types of cationic repeat units, multiple types of nonionic repeat units, and/or multiple types of anionic repeat units, one of ordinary skill can adjust the equation accordingly.

By way of example, a cationic homopolymer (molar ratio=100% or 1.00) with a monomer molecular weight of 161.67 g/mol, the CCD is calculated as follows: polymer charge density is (1)×(1.00)/(161.67)×1000=6.19 meq/g. A copolymer with a cationic monomer with a molecular weight of 161.67 and a neutral co-monomer with a molecular weight of 71.079 in a mol ratio of 1:1 is calculated as (1×0.50)/[(0.50×161.67)+(0.50×71.079)]*1000=4.3 meq/g.

A terpolymer with a cationic monomer with a molecular weight of 161.67, a neutral co-monomer with a molecular weight of 71.079, and an anionic co-monomer with a neutralized molecular weight of 94.04 g/mol in a mol ratio of 80.8:15.4:3.8 has a cationic charge density of 5.3 meq/g.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It is understood that the test methods that are disclosed in the Test Methods Section of the present application must be used to determine the respective values of the parameters of the compositions and methods described and claimed herein.

Method

The method disclosed herein relates to a method of treating a fabric, where the method comprises a washing step and a rinsing step. In some aspects, the method comprises: a washing step, where the washing step comprises contacting said fabric with an effective amount of a detergent composition, thereby forming a washed fabric, preferably where the detergent composition comprises a surfactant system and a silicone, preferably further comprising a cationic polymer, where the surfactant system comprises anionic surfactant and nonionic surfactant in a surfactant ratio of from about 1.1:1 to about 4:1; and then a rinsing step, where the washed fabric is contacted with an effective amount of a fabric softener composition, thereby forming a treated fabric, where the softener composition comprises a fabric softening active (FSA).

The method described herein may be undertaken by any conventional fabric treatment means, including by manual/hand washing means, or with the use of automatic laundry machines. Suitable automatic machines include conventional top loading machines such as the Kenmore 80 or Kenmore 600 series, high efficiency top loading machines such as the Whirlpool Cabrio, and front loading machines such as the Whirlpool Duet or Miele 1724. The automatic machines may comprise dispensing systems that automatically dispense the detergent composition and/or the softener composition at an appropriate stage of the laundering cycle. In some aspects, the washing step and the rinsing step occur in the same system, for example the same bucket or the same automatic washing machine.

In some aspects, the wash-and-rinse method of the present disclosure results in Silicone Deposition from 80 ug silicone/g to about 5000 ug silicone/g, or from about 100 ug silicone/g to about 2500 ug/g, or from about 200 ug silicone/g to about 1000 ug/g on the treated fabric, as determined by the test method given below.

In some aspects, the wash-and-rinse method of the present disclosure results in a Silicone Deposition Index of from about 4% to about 75%, or from about 5% to about 67%, or from about 6% to about 50%, or from about 7% to about 40%, or from about 8% to about 20% on the treated fabric, as determined by the test method given below.

In some aspects, the method comprises a pre-treatment step, according to conventional methods, typically where a soiled fabric is contacted with a detergent or additive composition and optionally rubbed prior to the washing step. In some aspects, the method comprises a drying step, where the treated fabric is dried by any suitable means, including line drying or machine drying.

The compositions described herein may be manufactured according to conventional means. The method and compositions comprised therein are described in more detail below.

Washing Step

In some aspects, the washing step comprises contacting a fabric with an effective amount of a detergent composition, thereby forming a washed fabric. The detergent composition is described in more detail below.

In some aspects, the fabric is contacted with the detergent composition in the presence of water, where the detergent composition and the water form a wash liquor. The fabric may be contacted with the detergent composition before, during, or after water is added. In some aspects, the wash liquor comprises from about 4 L of water to about 65 L of water.

In some aspects, the effective amount of the detergent composition is any amount sufficient to deliver a benefit, for example a cleaning benefit or a deposition benefit. In some aspects, the effective amount of the detergent composition is from about 5 grams to about 100 grams, or from about 10 grams to about 80 grams, or from about 20 grams to about 70 grams, or from about 25 grams to about 65 grams. In some aspects, the effective amount of the detergent composition is from about 5 milligrams to about 200 milligrams per kilogram of fabric, or from about 10 milligrams to about 150 milligrams, or from about 12 milligrams to about 100 milligrams, or from about 15 milligrams to about 80 milligrams (measured dry) to be treated. In some aspects, the effective amount of the detergent composition is from about 500 ppm to about 15,000 ppm, or from about 700 ppm to about 10,000 ppm, or from about 800 ppm to about 8,000 ppm, or from about 900 ppm to about 7,000 ppm, of the wash liquor.

The washing step may comprise mechanical agitation, e.g. manual or automatic agitation, of the fabric and wash liquor. Such agitation typically facilitates cleaning, e.g. stain removal.

In some aspects, the wash liquor is substantially removed from the washed fabric before the rinsing step occurs. In some aspects, the washed fabric may be rinsed at least once by water, forming a rinse liquor, after the wash liquor is substantially removed. In some aspects, the washed fabric may be rinsed in multiple rinsing steps, and the fabric softener composition is typically added to the last rinsing step.

Rinsing Step

In some aspects, the rinsing step comprises contacting a fabric with an effective amount of a fabric softener composition ("softener composition"), thereby forming a washed fabric. The softener composition is described in more detail below.

In some aspects, the fabric is contacted with the softener composition in the presence of water, where the softener composition and the water form a rinse liquor. The fabric may be contacted with the softener composition before, during, or after water is added. In some aspects, the rinse liquor comprises from about 4 L of water to about 65 L of water. In some aspects, the washed fabric may be rinsed in multiple rinsing steps, and the fabric is typically contacted with the softener composition in the last rinsing step. Typically, the rinse liquor is substantially removed from the treated fabric.

The softener composition may be added in any suitable manner. For example, the softener composition may be added via a dispensing drawer or port on an automatic washing machine, added directly to the washed fabric or rinse liquor, or via an independent softener dispensing device, such as a DOWNY BALL™. In some aspects, although less preferred, the softener composition is added during the washing step, and residual amounts remain contacting the fabric during the rinsing step.

In some aspects, the effective amount of the softener composition is any amount sufficient to deliver a benefit, for example a softening benefit. In some aspects, the effective amount of the softener composition is from about 5 grams to about 100 grams, or from about 10 grams to about 80 grams, or from about 20 grams to about 50 grams. In some aspects, the effective amount of the softener composition is from about 4 milligrams to about 50 milligrams per kilogram of fabric, or from about 5 milligrams to about 40 milligrams, or from about 5 milligrams to about 30 milligrams, or from about 5.5 milligrams to about 25 milligrams grams per kilogram of fabric (measured dry) to be treated. In some aspects, the effective amount of the softener composition is from about 300 ppm to about 3,000 ppm, or from about 500 ppm to about 2,000 ppm, or from about 600 ppm to about 1,500 ppm of the rinse liquor.

The rinsing step may comprise mechanical agitation, e.g. manual or automatic agitation, of the fabric and rinsing liquor. Such agitation typically facilitates uniform deposition of the fabric softening active and/or of softening benefits.

In some aspects, the method further comprises a drying step, where the treated fabric is dried by any suitable method, for example by line drying or with an automatic clothes dryer.

Detergent Composition

The method described herein comprises a washing step, where a fabric is contacted with a detergent composition, where the detergent composition comprises a surfactant system. Suitable detergent compositions are described below.

Form

The detergent compositions may have any suitable form, including a form selected from liquid, powder, single-phase or multi-phase unit dose, pouch, tablet, gel, paste, bar, or flake.

The detergent composition is preferably a liquid laundry detergent. The liquid laundry detergent composition preferably has a viscosity from about 1 to about 2000 centipoise (1-2000 mPa·s), or from about 200 to about 800 centipoise (200-800 mPa·s). The viscosity is determined using a Brookfield viscometer, No. 2 spindle, at 60 RPM/s, measured at 25° C.

In one embodiment, the detergent composition is a solid laundry detergent composition, and preferably a free-flowing particulate laundry detergent composition (i.e., a granular detergent product).

In some aspects, the detergent composition is in unit dose form. A unit dose article is intended to provide a single, easy to use dose of the composition contained within the article for a particular application. The unit dose form may be a pouch or a water-soluble sheet. A pouch may comprise at least one, or at least two, or at least three compartments. Typically, the composition is contained in at least one of the compartments. The compartments may be arranged in superposed orientation, i.e., one positioned on top of the other, where they may share a common wall. In one aspect, at least one compartment is superposed on another compartment. Alternatively, the compartments may be positioned in a side-by-side orientation, i.e., one orientated next to the other. The compartments may even be orientated in a "tire and rim" arrangement, i.e., a first compartment is positioned next to a second compartment, but the first compartment at least partially surrounds the second compartment, but does not completely enclose the second compartment. Alternatively, one compartment may be completely enclosed within another compartment.

In some aspects, the unit dose form comprises water-soluble film that forms the compartment and encapsulates the detergent composition. Preferred film materials are preferably polymeric materials; for example, the water-soluble film may comprise polyvinyl alcohol. The film material can, for example, be obtained by casting, blow-moulding, extrusion, or blown extrusion of the polymeric material, as known in the art. Suitable films are those supplied by Monosol (Merrillville, Ind., USA) under the trade references M8630, M8900, M8779, and M8310, films described in U.S. Pat. No. 6,166,117, U.S. Pat. No. 6,787,512, and US2011/0188784, and PVA films of corresponding solubility and deformability characteristics.

When the fabric care composition is a liquid, the fabric care composition typically comprises water. The composition may comprise from about 1% to about 80%, by weight of the composition, water. When the composition is a liquid composition, for example a heavy duty liquid detergent composition, the composition typically comprises from about 40% to about 80% water. When the composition is a compact liquid detergent, the composition typically comprises from about 20% to about 60%, or from about 30% to about 50% water. When the composition is in unit dose form, for example, encapsulated in water-soluble film, the composition typically comprises less than 20%, or less than 15%, or less than 12%, or less than 10%, or less than 8%, or less than 5% water. In some aspects, the composition comprises from about 1% to 20%, or from about 3% to about 15%, or from about 5% to about 12%, by weight of the composition, water.

Surfactant System

The detergent compositions of the present disclosure comprise a surfactant system. Surfactant systems are known to effect cleaning benefits. However, it has been found that careful selection of particular surfactant systems can also provide softness and/or deposition benefits when used in combination with softener compositions in a fabric treatment regimen.

Typically, the detergent compositions of the present disclosure comprise a surfactant system in an amount sufficient to provide desired cleaning properties. In some embodiments, the detergent composition comprises, by weight of the composition, from about 1% to about 70% of a surfactant system. In other embodiments, the cleaning composition comprises, by weight of the composition, from about 2% to about 60% of the surfactant system. In further embodiments, the cleaning composition comprises, by weight of the composition, from about 5% to about 30% of the surfactant system. In some embodiments, the cleaning composition comprises from about 20% to about 60%, or from about 35% to about 50%, by weight of the composition, of the surfactant system.

The surfactant system may comprise a detersive surfactant selected from anionic surfactants, nonionic surfactants, cationic surfactants, zwitterionic surfactants, amphoteric surfactants, ampholytic surfactants, and mixtures thereof. Those of ordinary skill in the art will understand that a detersive surfactant encompasses any surfactant or mixture of surfactants that provide cleaning, stain removing, or laundering benefit to soiled material. As used herein, fatty acids and their salts are understood to be part of the surfactant system.

Anionic Surfactant/Nonionic Surfactant Combinations

The surfactant system typically comprises anionic surfactant and nonionic surfactant in a weight ratio. The careful selection of the weight ratio of anionic surfactant to nonionic surfactant is important in order for the presently disclosed compositions and methods to provide the desired levels of feel and cleaning benefits.

In some aspects, the weight ratio of anionic surfactant to nonionic surfactant is from about 1.1:1 to about 4:1, or preferably from about 1.2:1 to about 3:1, or preferably from about 1.5:1 to about 2.5:1, or even more preferably about 2:1. Anionic surfactants and nonionic surfactants are described in more detail below.

Anionic Surfactants

The surfactant system comprises anionic surfactant. In some examples, the surfactant system of the cleaning composition may comprise from about 1% to about 70%, by weight of the surfactant system, of one or more anionic surfactants. In other examples, the surfactant system of the cleaning composition may comprise from about 2% to about 60%, by weight of the surfactant system, of one or more anionic surfactants. In further examples, the surfactant system of the cleaning composition may comprise from about 5% to about 30%, by weight of the surfactant system, of one or more anionic surfactants. Specific, non-limiting examples of suitable anionic surfactants include any conventional anionic surfactant. This may include a sulfate detersive surfactant, e.g., alkoxylated and/or non-alkoxylated alkyl sulfate material, and/or sulfonic detersive surfactants, e.g., alkyl benzene sulfonates. In some aspects, the anionic surfactant of the surfactant system comprises a sulfonic detersive surfactant and a sulfate detersive surfactant, preferably linear alkyl benzene sulfonate (LAS) and alkyl ethoxylated sulfate (AES), in a weight ratio. In some aspects, the weight ratio of sulfonic detersive surfactant, e.g., LAS, to sulfate detersive surfactant, e.g., AES, is from about 1:9 to about 9:1, or from about 1:6 to about 6:1, or from about 1:4 to about 4:1, or from about 1:2 to about 2:1, or about 1:1. In some aspects, the weight ratio of sulfonic detersive surfactant, e.g., LAS, to sulfate detersive surfactant, e.g., AES, is from about 1:9, or from about 1:6, or from about 1:4, or from about 1:2, to about 1:1. In some aspects, increasing the level of AES relative to the level of LAS facilitates improved silicone deposition.

Alkoxylated alkyl sulfate materials comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. (Included in the term "alkyl" is the alkyl portion of acyl groups. In some examples, the alkyl group contains from about 15 carbon atoms to about 30 carbon atoms. In other examples, the alkyl ether sulfate surfactant may be a mixture of alkyl ether sulfates, said mixture having an average (arithmetic mean) carbon chain length within the range of about 12 to 30 carbon atoms, and in some examples an average carbon chain length of about 25 carbon atoms, and an average (arithmetic mean) degree of ethoxylation of from about 1 mol to 4 mols of ethylene oxide, and in some examples an average (arithmetic mean) degree of ethoxylation of 1.8 mols of ethylene oxide. In further examples, the alkyl ether sulfate surfactant may have a carbon chain length between about 10 carbon atoms to about 18 carbon atoms, and a degree of ethoxylation of from about 1 to about 6 mols of ethylene oxide.

Non-ethoxylated alkyl sulfates may also be added to the disclosed cleaning compositions and used as an anionic surfactant component. Examples of non-alkoxylated, e.g., non-ethoxylated, alkyl sulfate surfactants include those produced by the sulfation of higher $C_8$-$C_{20}$ fatty alcohols. In some examples, primary alkyl sulfate surfactants have the general formula: $ROSO_3^-M^+$, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium.

Other useful anionic surfactants can include the alkali metal salts of alkyl benzene sulfonates, in which the alkyl group contains from about 9 to about 15 carbon atoms, in straight chain (linear) or branched chain configuration, e.g. those of the type described in U.S. Pat. Nos. 2,220,099 and 2,477,383. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS. Such surfactants and their preparation are described for example in U.S. Pat. Nos. 2,220,099 and 2,477,383.

Other anionic surfactants useful herein are the water-soluble salts of: paraffin sulfonates and secondary alkane sulfonates containing from about 8 to about 24 (and in some examples about 12 to 18) carbon atoms; alkyl glyceryl ether sulfonates, especially those ethers of $C_{8-18}$ alcohols (e.g., those derived from tallow and coconut oil). Mixtures of the alkylbenzene sulfonates with the above-described paraffin sulfonates, secondary alkane sulfonates and alkyl glyceryl ether sulfonates are also useful. Further suitable anionic surfactants useful herein may be found in U.S. Pat. No. 4,285,841, Barrat et al., issued Aug. 25, 1981, and in U.S. Pat. No. 3,919,678, Laughlin, et al., issued Dec. 30, 1975, both of which are herein incorporated by reference.

Fatty Acids

Other anionic surfactants useful herein are fatty acids and/or their salts. Therefore, in some aspects, the detergent composition comprises a fatty acid and/or its salt. Without wishing to be bound by theory, it is believed that in the present compositions, fatty acids and/or their salts act as a builder and contributes to fabric softness. However, fatty acid is not required in the present compositions, and there may be processing, cost, and stability advantages to minimizing fatty acid, or even eliminating it completely.

The composition may comprise from about 0.1%, or from about 0.5%, or from about 1%, to about 40%, or to about 30%, or to about 20%, or to about 10%, to about 8%, or to about 5%, or to about 4%, or to about 3.5% by weight of a fatty acid or its salt. In some aspects, the detergent composition is substantially free (or comprises 0%) of fatty acids and their salts.

Suitable fatty acids and salts include those having the formula R1COOM, where R1 is a primary or secondary alkyl group of 4 to 30 carbon atoms, and where M is a hydrogen cation or another solubilizing cation. In the acid form, M is a hydrogen cation; in the salt form, M is a solubilizing cation that is not hydrogen. While the acid (i.e., wherein M is a hydrogen cation) is suitable, the salt is typically preferred since it has a greater affinity for the cationic polymer. Therefore, the fatty acid or salt is preferably selected such that the pKa of the fatty acid or salt is less than the pH of the non-aqueous liquid composition. In some aspects, the composition preferably has a pH of from 6 to 10.5, more preferably 6.5 to 9, most preferably 7 to 8.

The alkyl group represented by R1 may represent a mixture of chain lengths and may be saturated or unsaturated, although it is preferred that at least two thirds of the R1 groups have a chain length of between 8 and 18 carbon atoms. Non-limiting examples of suitable alkyl group sources include the fatty acids derived from coconut oil, tallow, tall oil, rapeseed-derived, oleic, fatty alkylsuccinic, palm kernel oil, and mixtures thereof. For the purposes of minimizing odor, however, it is often desirable to use primarily saturated carboxylic acids.

The solubilizing cation, M (when M is not a hydrogen cation), may be any cation that confers water solubility to the product, although monovalent moieties are generally preferred. Examples of suitable solubilizing cations for use with this disclosure include alkali metals such as sodium and potassium, which are particularly preferred, and amines such as monoethanolamine, triethanolammonium, ammonium, and morpholinium. Although, when used, the majority of the fatty acid should be incorporated into the composition in neutralized salt form, it is often preferable to leave an amount of free fatty acid in the composition, as this can aid in the maintenance of the viscosity of the composition, particularly when the composition has low water content, for example less than 20%.

Branched Surfactants

The anionic surfactant may comprise anionic branched surfactants. Suitable anionic branched surfactants may be selected from branched sulphate or branched sulphonate surfactants, e.g., branched alkyl sulphate, branched alkyl alkoxylated sulphate, and branched alkyl benzene sulphonates, comprising one or more random alkyl branches, e.g., $C_{1-4}$ alkyl groups, typically methyl and/or ethyl groups.

In some aspects, the branched detersive surfactant is a mid-chain branched detersive surfactant, typically, a mid-chain branched anionic detersive surfactant, for example, a mid-chain branched alkyl sulphate and/or a mid-chain branched alkyl benzene sulphonate. In some aspects, the detersive surfactant is a mid-chain branched alkyl sulphate. In some aspects, the mid-chain branches are $C_{1-4}$ alkyl groups, typically methyl and/or ethyl groups.

In some aspects, the branched surfactant comprises a longer alkyl chain, mid-chain branched surfactant compound of the formula:

$$A_b\text{-X—B}$$

where:

(a) $A_b$ is a hydrophobic C9 to C22 (total carbons in the moiety), typically from about C12 to about C18, mid-chain branched alkyl moiety having: (1) a longest linear carbon chain attached to the —X—B moiety in the range of from 8 to 21 carbon atoms; (2) one or more C1-C3 alkyl moieties branching from this longest linear carbon chain; (3) at least one of the branching alkyl moieties is attached directly to a carbon of the longest linear carbon chain at a position within the range of position 2 carbon (counting from carbon #1 which is attached to the —X—B moiety) to position ω-2 carbon (the terminal carbon minus 2 carbons, i.e., the third carbon from the end of the longest linear carbon chain); and (4) the surfactant composition has an average total number of carbon atoms in the $A_b$-X moiety in the above formula within the range of greater than 14.5 to about 17.5 (typically from about 15 to about 17);

b) B is a hydrophilic moiety selected from sulfates, sulfonates, amine oxides, polyoxyalkylene (such as polyoxyethylene and polyoxypropylene), alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkylated/polyhydroxyalkylated quats, alkylated/polyhydroxylated oxypropyl quats, imidazolines, 2-ylsuccinates, sulfonated alkyl esters, and sulfonated fatty acids (it is to be noted that more than one hydrophobic moiety may be attached to B, for example as in $(A_b\text{-X})_z$—B to give dimethyl quats); and (c) X is selected from —CH2- and —C(O)—.

Generally, in the above formula the $A_b$ moiety does not have any quaternary substituted carbon atoms (i.e., 4 carbon atoms directly attached to one carbon atom). Depending on which hydrophilic moiety (B) is selected, the resultant surfactant may be anionic, nonionic, cationic, zwitterionic, amphoteric, or ampholytic. In some aspects, B is sulfate and the resultant surfactant is anionic.

In some aspects, the branched surfactant comprises a longer alkyl chain, mid-chain branched surfactant compound of the above formula wherein the $A_b$ moiety is a branched primary alkyl moiety having the formula:

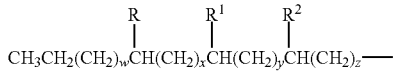

wherein the total number of carbon atoms in the branched primary alkyl moiety of this formula (including the R, $R^1$, and $R^2$ branching) is from 13 to 19; R, R1, and R2 are each independently selected from hydrogen and C1-C3 alkyl (typically methyl), provided R, R1, and R2 are not all hydrogen and, when z is 0, at least R or R1 is not hydrogen; w is an integer from 0 to 13; x is an integer from 0 to 13; y is an integer from 0 to 13; z is an integer from 0 to 13; and w+x+y+z is from 7 to 13.

In certain aspects, the branched surfactant comprises a longer alkyl chain, mid-chain branched surfactant compound of the above formula wherein the $A_b$ moiety is a branched primary alkyl moiety having the formula selected from:

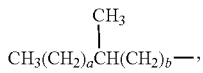

(I)

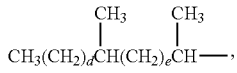

(II)

or mixtures thereof; wherein a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and bis an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12.

In the mid-chain branched surfactant compounds described above, certain points of branching (e.g., the location along the chain of the R, $R^1$, and/or $R^2$ moieties in the above formula) are preferred over other points of branching along the backbone of the surfactant. The formula below illustrates the mid-chain branching range (i.e., where points of branching occur), preferred mid-chain branching range, and more preferred mid-chain branching range for mono-methyl branched alkyl $A^b$ moieties.

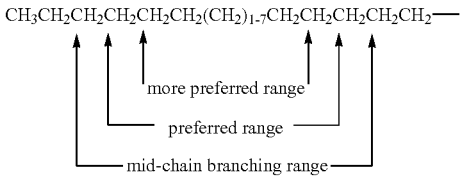

For mono-methyl substituted surfactants, these ranges exclude the two terminal carbon atoms of the chain and the carbon atom immediately adjacent to the —X—B group.

The formula below illustrates the mid-chain branching range, preferred mid-chain branching range, and more preferred mid-chain branching range for di-methyl substituted alkyl $A^b$ moieties.

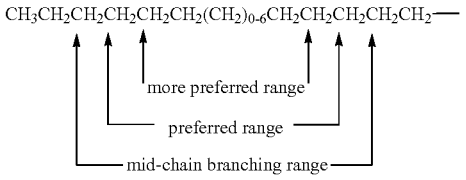

Additional suitable branched surfactants are disclosed in U.S. Pat. No. 6,008,181, U.S. Pat. No. 6,060,443, U.S. Pat. No. 6,020,303, U.S. Pat. No. 6,153,577, U.S. Pat. No. 6,093,856, U.S. Pat. No. 6,015,781, U.S. Pat. No. 6,133,222, U.S. Pat. No. 6,326,348, U.S. Pat. No. 6,482,789, U.S. Pat. No. 6,677,289, U.S. Pat. No. 6,903,059, U.S. Pat. No. 6,660,711, U.S. Pat. No. 6,335,312, and WO 9918929. Yet other suitable branched surfactants include those described in WO9738956, WO9738957, and WO0102451.

In some aspects, the branched anionic surfactant comprises a branched modified alkylbenzene sulfonate (MLAS), as discussed in WO 99/05243, WO 99/05242, WO 99/05244, WO 99/05082, WO 99/05084, WO 99/05241, WO 99/07656, WO 00/23549, and WO 00/23548.

In some aspects, the branched anionic surfactant comprises a C12/13 alcohol-based surfactant comprising a methyl branch randomly distributed along the hydrophobe chain, e.g., Safol®, Marlipal® available from Sasol.

Further suitable branched anionic detersive surfactants include surfactants derived from alcohols branched in the 2-alkyl position, such as those sold under the trade names Isalchem®123, Isalchem®125, Isalchem®145, Isalchem®167, which are derived from the oxo process. Due to the oxo process, the branching is situated in the 2-alkyl position. These 2-alkyl branched alcohols are typically in the range of C11 to C14/C15 in length and comprise structural isomers that are all branched in the 2-alkyl position. These branched alcohols and surfactants are described in US20110033413.

Other suitable branched surfactants include those disclosed in U.S. Pat. No. 6,037,313 (P&G), WO9521233 (P&G), U.S. Pat. No. 3,480,556 (Atlantic Richfield), U.S. Pat. No. 6,683,224 (Cognis), US20030225304A1 (Kao), US2004236158A1 (R&H), U.S. Pat. No. 6,818,700 (Atofina), US2004154640 (Smith et al), EP1280746 (Shell), EP1025839 (L'Oreal), U.S. Pat. No. 6,765,119 (BASF), EP1080084 (Dow), U.S. Pat. No. 6,723,867 (Cognis), EP1401792A1 (Shell), EP1401797A2 (Degussa AG), US2004048766 (Raths et al), U.S. Pat. No. 6,596,675 (L'Oreal), EP1136471 (Kao), EP961765 (Albemarle), U.S. Pat. No. 6,580,009 (BASF), US2003105352 (Dado et al), U.S. Pat. No. 6,573,345 (Cryovac), DE10155520 (BASF), U.S. Pat. No. 6,534,691 (du Pont), U.S. Pat. No. 6,407,279 (ExxonMobil), U.S. Pat. No. 5,831,134 (Peroxid-Chemie), U.S. Pat. No. 5,811,617 (Amoco), U.S. Pat. No. 5,463,143 (Shell), U.S. Pat. No. 5,304,675 (Mobil), U.S. Pat. No. 5,227,544 (BASF), U.S. Pat. No. 5,446,213A (MITSUBISHI KASEI CORPORATION), EP1230200A2 (BASF), EP1159237B1 (BASF), US20040006250A1 (NONE), EP1230200B1 (BASF), WO2004014826A1 (SHELL), U.S. Pat. No. 6,703,535B2 (CHEVRON), EP1140741B1 (BASF), WO2003095402A1 (OXENO), U.S. Pat. No. 6,765,106B2 (SHELL), US20040167355A1 (NONE), U.S. Pat. No. 6,700,027B1 (CHEVRON), US20040242946A1 (NONE), WO2005037751A2 (SHELL), WO2005037752A1 (SHELL), U.S. Pat. No. 6,906,230B1 (BASF), WO2005037747A2 (SHELL) OIL COMPANY.

Additional suitable branched anionic detersive surfactants include surfactant derivatives of isoprenoid-based polybranched detergent alcohols, as described in US 2010/0137649. Isoprenoid-based surfactants and isoprenoid derivatives are also described in the book entitled "Comprehensive Natural Products Chemistry: Isoprenoids Including Carotenoids and Steroids (Vol. two)", Barton and Nakanishi, © 1999, Elsevier Science Ltd and are included in the structure E, and are hereby incorporated by reference.

Further suitable branched anionic detersive surfactants include those derived from anteiso and iso-alcohols. Such surfactants are disclosed in WO2012009525.

Additional suitable branched anionic detersive surfactants include those described in US Patent Application Nos. 2011/0171155A1 and 2011/0166370A1.

Suitable branched anionic surfactants also include Guerbet-alcohol-based surfactants. Guerbet alcohols are branched, primary monofunctional alcohols that have two linear carbon chains with the branch point always at the second carbon position. Guerbet alcohols are chemically described as 2-alkyl-1-alkanols. Guerbet alcohols generally have from 12 carbon atoms to 36 carbon atoms. The Guerbet alcohols may be represented by the following formula: $(R1)(R2)CHCH_2OH$, where R1 is a linear alkyl group, R2 is a linear alkyl group, the sum of the carbon atoms in R1 and R2 is 10 to 34, and both R1 and R2 are present. Guerbet alcohols are commercially available from Sasol as Isofol® alcohols and from Cognis as Guerbetol.

The surfactant system disclosed herein may comprise any of the branched surfactants described above individually or the surfactant system may comprise a mixture of the branched surfactants described above. Furthermore, each of the branched surfactants described above may include a bio-based content. In some aspects, the branched surfactant has a bio-based content of at least about 50%, at least about 60%, at least about 70%, at least about 80%, at least about 90%, at least about 95%, at least about 97%, or about 100%.

Nonionic Surfactants

The surfactant systems of the cleaning composition typically comprise nonionic surfactant. In some examples, the surfactant system comprises up to about 50%, by weight of the surfactant system, of one or more nonionic surfactants, e.g., as a co-surfactant. In some aspects, the surfactant system comprises from about 5% to about 50%, or from about 10% to about 50%, or from about 20% to about 50%, by weight of the surfactant system, of nonionic surfactant.

Suitable nonionic surfactants useful herein can comprise any conventional nonionic surfactant. These can include, for e.g., alkoxylated fatty alcohols and amine oxide surfactants. In some examples, the cleaning compositions may contain an ethoxylated nonionic surfactant. These materials are described in U.S. Pat. No. 4,285,841, Barrat et al, issued Aug. 25, 1981. The nonionic surfactant may be selected from the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. In one example, the nonionic surfactant is selected from ethoxylated alcohols having an average of about 24 carbon atoms in the alcohol and an average degree of ethoxylation of about 9 moles of ethylene oxide per mole of alcohol.

Other non-limiting examples of nonionic surfactants useful herein include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1 to 30, as discussed in U.S. Pat. No. 6,153,577, U.S. Pat. No. 6,020,303 and U.S. Pat. No. 6,093,856; Alkylpolysaccharides as discussed in U.S. Pat. No. 4,565,647 to Llenado, issued Jan. 26, 1986; specifically alkylpolyglycosides as discussed in U.S. Pat. No. 4,483,780 and U.S. Pat. No. 4,483,779; Polyhydroxy fatty acid amides as discussed in U.S. Pat. No. 5,332,528, WO 92/06162, WO 93/19146, WO 93/19038, and WO 94/09099; and ether capped poly(oxyalkylated) alcohol surfactants as discussed in U.S. Pat. No. 6,482,994 and WO 01/42408.

Cationic Surfactants

The surfactant system may comprise a cationic surfactant. In some aspects, the surfactant system comprises from about 0% to about 7%, or from about 0.1% to about 5%, or from about 1% to about 4%, by weight of the surfactant system, of a cationic surfactant, e.g., as a co-surfactant. Non-limiting examples of cationic include: the quaternary ammonium surfactants, which can have up to 26 carbon atoms include: alkoxylate quaternary ammonium (AQA) surfactants as discussed in U.S. Pat. No. 6,136,769; dimethyl hydroxyethyl quaternary ammonium as discussed in U.S. Pat. No. 6,004,922; dimethyl hydroxyethyl lauryl ammonium chloride; polyamine cationic surfactants as discussed in WO 98/35002, WO 98/35003, WO 98/35004, WO 98/35005, and WO 98/35006; cationic ester surfactants as discussed in U.S. Pat. Nos. 4,228,042, 4,239,660 4,260,529 and U.S. Pat. No. 6,022,844; and amino surfactants as discussed in U.S. Pat. No. 6,221,825 and WO 00/47708, specifically amido propyldimethyl amine (APA).

In some aspects, the cleaning compositions of the present disclosure are substantially free of cationic surfactants and/or of surfactants that become cationic below a pH of 7 or below a pH of 6.

Zwitterionic Surfactants

In some aspects, the surfactant system comprises a zwitterionic surfactant. Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaines, including alkyl dimethyl betaine and cocodimethyl amidopropyl betaine, $C_8$ to $C_{18}$ (for example from $C_{12}$ to $C_{18}$) amine oxides and sulfo and hydroxy betaines, such as N-alkyl-N, N-dimethylamino-1-propane sulfonate where the alkyl group can be $C_8$ to $C_{18}$ and in certain embodiments from $C_{10}$ to $C_{14}$.

Ampholytic Surfactants

In some aspects, the surfactant system comprises an ampholytic surfactant. Specific, non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents may contain at least about 8 carbon atoms, for example from about 8 to about 18 carbon atoms, and at least one contains an anionic water-solubilizing group, e.g. carboxy, sulfonate, sulfate. See U.S. Pat. No. 3,929,678 at column 19, lines 18-35, for suitable examples of ampholytic surfactants.

Amphoteric Surfactants

In some aspects, the surfactant system comprises an amphoteric surfactant. Examples of amphoteric surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. Examples of compounds falling within this definition are sodium 3-(dodecylamino)propionate, sodium 3-(dodecylamino) propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-iminodiacetate, sodium 1-carboxymethyl-2-undecylimidazole, and sodium N,N-bis (2-hydroxyethyl)-2-sulfato-3-dodecoxypropylamine See U.S. Pat. No. 3,929,678 to Laughlin et al., issued Dec. 30, 1975 at column 19, lines 18-35, for examples of amphoteric surfactants. In some aspects, the surfactant system is substantially free of amphoteric surfactant.

In one aspect, the surfactant system comprises an anionic surfactant and, as a co-surfactant, a nonionic surfactant, for example, a $C_{12}$-$C_{18}$ alkyl ethoxylate. In another aspect, the surfactant system comprises $C_{10}$-$C_{15}$ alkyl benzene sulfonates (LAS) and, as a co-surfactant, an anionic surfactant, e.g., $C_{10}$-$C_{18}$ alkyl alkoxy sulfates ($AE_xS$), where x is from 1-30. In another aspect, the surfactant system comprises an anionic surfactant and, as a co-surfactant, a cationic surfactant, for example, dimethyl hydroxyethyl lauryl ammonium chloride.

Silicone

The present fabric care compositions may comprise silicone, which is a benefit agent known to provide feel and/or color benefits to fabrics. Applicants have surprisingly found that compositions comprising silicone, cationic polymer, and surfactant systems according to the present disclosure provide improved softness and/or whiteness benefits.

The fabric care composition may comprise from about 0.1% to about 30%, or from about 0.1% to about 15%, or from about 0.2% to about 12%, or from about 0.5% to about 10%, or from about 0.7% to about 9%, or from about 1% to about 5%, by weight of the composition, of silicone.

The silicone may be a polysiloxane, which is a polymer comprising Si—O moieties. The silicone may be a silicone that comprises functionalized siloxane moieties. Suitable silicones may comprise Si—O moieties and may be selected from (a) non-functionalized siloxane polymers, (b) functionalized siloxane polymers, and combinations thereof. The functionalized siloxane polymer may comprise an aminosilicone, silicone polyether, polydimethyl siloxane (PDMS), cationic silicones, silicone polyurethane, silicone polyureas, or mixtures thereof. The silicone may comprise a cyclic silicone. The cyclic silicone may comprise a cyclomethicone of the formula $[(CH_3)_2SiO]_n$ where n is an integer that may range from about 3 to about 7, or from about 5 to about 6.

The molecular weight of the silicone is usually indicated by the reference to the viscosity of the material. The silicones may comprise a viscosity of from about 10 to about 2,000,000 centistokes at 25° C. Suitable silicones may have a viscosity of from about 10 to about 800,000 centistokes, or from about 100 to about 200,000 centistokes, or from about 1000 to about 100,000 centistokes, or from about 2000 to about 50,000 centistokes, or from about 2500 to about 10,000 centistokes, at 25° C.

Suitable silicones may be linear, branched or cross-linked. The silicones may comprise silicone resins. Silicone resins are highly cross-linked polymeric siloxane systems. The cross-linking is introduced through the incorporation of trifunctional and tetrafunctional silanes with monofunctional or difunctional, or both, silanes during manufacture of the silicone resin. As used herein, the nomenclature SiO"n"/2 represents the ratio of oxygen to silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

The silicone may comprise a non-functionalized siloxane polymer. The non-functionalized siloxane polymer may comprise polyalkyl and/or phenyl silicone fluids, resins and/or gums. The non-functionalized siloxane polymer may have Formula (I) below:

Formula (I)

$$[R_1R_2R_3SiO_{1/2}]_n[R_4R_4SiO_{2/2}]_m[R_4SiO_{3/2}]_j$$

wherein:

i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;

ii) n may be an integer from about 2 to about 10, or from about 2 to about 6; or 2; such that n=j+2;

iii) m may be an integer from about 5 to about 8,000, from about 7 to about 8,000 or from about 15 to about 4,000;

iv) j may be an integer from 0 to about 10, or from 0 to about 4, or 0.

$R_2$, $R_3$ and $R_4$ may comprise methyl, ethyl, propyl, $C_4$-$C_{20}$ alkyl, and/or $C_6$-$C_{20}$ aryl moieties. Each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

The silicone may comprise a functionalized siloxane polymer. Functionalized siloxane polymers may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

The functionalized siloxane polymer may comprise a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in USPA 2005/0098759, and U.S. Pat. Nos. 4,818,421 and 3,299,112. Exemplary commercially available silicone polyethers include DC 190, DC 193, FF400, all available from Dow Corning® Corporation, and various Silwet® surfactants available from Momentive Silicones.

The silicone may be chosen from a random or blocky silicone polymer having the following Formula (II) below:

Formula (II)

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein:

j is an integer from 0 to about 98; in one aspect j is an integer from 0 to about 48; in one aspect, j is 0;

k is an integer from 0 to about 200, in one aspect k is an integer from 0 to about 50, or from about 2 to about 20; when k=0, at least one of $R_1$, $R_2$ or $R_3$ is —X—Z;

m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X in said alkyl siloxane polymer comprises a substituted or unsubstituted divalent alkylene radical comprising 2-12 carbon atoms, in one aspect each divalent alkylene radical is independently selected from the group consisting of —$(CH_2)_s$— wherein s is an integer from about 2 to about 8, from about 2 to about 4; in one aspect, each X in said alkyl siloxane polymer comprises a substituted divalent alkylene radical selected from the group consisting of: —$CH_2$—CH(OH)—$CH_2$—; —

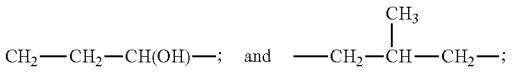

each Z is selected independently from the group consisting of

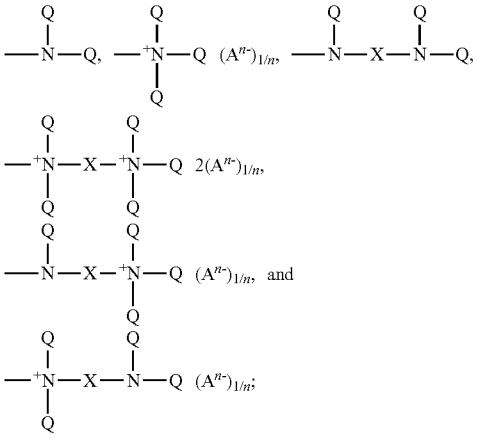

with the proviso that when Z is a quat, Q cannot be an amide, imine, or urea moiety;

for Z $A^{n-}$ is a suitable charge balancing anion; for example, $A^{n-}$ may be selected from the group consisting of $Cl^-$, $Br^-$, $I^-$, methylsulfate, toluene sulfonate, carboxylate and phosphate; and at least one Q in said silicone is independently selected from H; —$CH_2$—CH(OH)—$CH_2$—$R_5$;

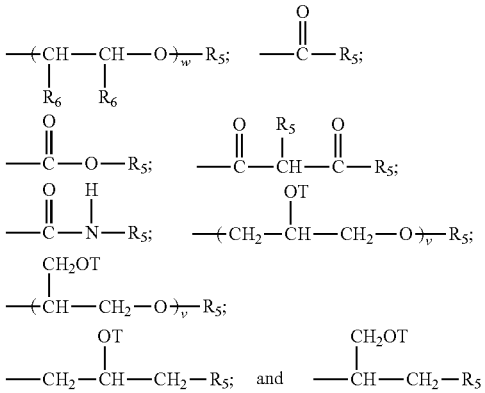

each additional Q in said silicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$CH_2$—CH(OH)—$CH_2$—$R_5$;

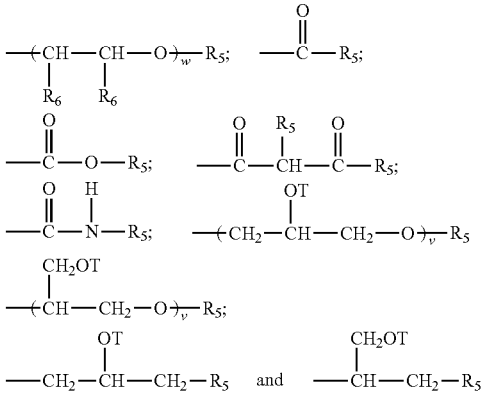

wherein each $R_5$ is independently selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$(CHR_6$—$CHR_6$—O-$)_w$-L and a siloxyl residue;

each $R_6$ is independently selected from H, $C_1$-$C_{18}$ alkyl each L is independently selected from —C(O)—$R_7$ or $R_7$;

w is an integer from 0 to about 500, in one aspect w is an integer from about 1 to about 200; in one aspect w is an integer from about 1 to about 50;

each $R_7$ is selected independently from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl; $C_6$-$C_{32}$ substituted alkylaryl and a siloxyl residue;

each T is independently selected from H, and

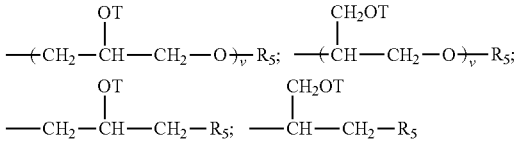

and wherein each v in said silicone is an integer from 1 to about 10, in one aspect, v is an integer from 1 to about 5 and the sum of all v indices in each Q in the silicone is an integer from 1 to about 30 or from 1 to about 20 or even from 1 to about 10.

$R_1$ may comprise —OH.

The functionalized siloxane polymer may comprise an aminosilicone. The aminosilicone may comprise a functional group. The functional group may comprise a monoamine, a diamine, or mixtures thereof. The functional group may comprise a primary amine, a secondary amine, a tertiary amine, quaternized amines, or combinations thereof. The functional group may comprise primary amine, a secondary amine, or combinations thereof.

For example, the functionalized siloxane polymer may comprise an aminosilicone having a formula according to Formula II (above), where: j is 0; k is an integer from 1 to about 10; m is an integer from 150 to about 1000, or from about 325 to about 750, or from about 400 to about 600; each $R_1$, $R_2$ and $R_3$ is selected independently from $C_1$-$C_{32}$ alkoxy and $C_1$-$C_{32}$ alkyl; each $R_4$ is $C_1$-$C_{32}$ alkyl; each X is selected from the group consisting of $—(CH_2)_s—$ wherein s is an integer from about 2 to about 8, or from about 2 to about 4; and each Z is selected independently from the group consisting of

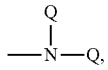

where each Q in the silicone is selected from the group comprising of H.

The functionalized siloxane polymer may comprise an aminosilicone having a formula according to Formula II (above), where: j is 0; k is an integer from 1 to about 10; m is an integer from 150 to about 1000, or from about 325 to about 750, or from about 400 to about 600; each $R_1$, $R_2$ and $R_3$ is selected independently from $C_1$-$C_{32}$ alkoxy and $C_1$-$C_{32}$ alkyl; each $R_4$ is $C_1$-$C_{32}$ alkyl; each X is selected from the group consisting of $—(CH_2)_s—$ wherein s is an integer from about 2 to about 8, or from about 2 to about 4; and each Z is selected independently from the group consisting of

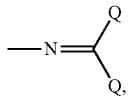

where each Q in the silicone is independently selected from the group consisting of H, C1-C32 alkyl, C1-C32 substituted alkyl, C6-C32 aryl, C5-C32 substituted aryl, C6-C32 alkylaryl, and C5-C32 substituted alkylaryl; with the proviso that both Q cannot be H atoms.

Other suitable aminosilicones are described in U.S. Pat. Nos. 7,335,630 B2 and 4,911,852, and USPA 2005/0170994A1. The aminosilicone may be that described in U.S. PA 61/221,632.

Exemplary commercially available aminosilicones include: DC 8822, 2-8177, and DC-949, available from Dow Corning® Corporation; KF-873, available from Shin-Etsu Silicones, Akron, Ohio; and Magnasoft Plus, available from Momentive (Columbus, Ohio, USA).

The functionalized siloxane polymer may comprise silicone-urethanes, such as those described in U.S. PA 61/170,150. These are commercially available from Wacker Silicones under the trade name SLM-21200®.

Other modified silicones or silicone copolymers may also be useful herein. Examples of these include silicone-based quaternary ammonium compounds (Kennan quats) disclosed in U.S. Pat. Nos. 6,607,717 and 6,482,969; end-terminal quaternary siloxanes; silicone aminopolyalkylene-oxide block copolymers disclosed in U.S. Pat. Nos. 5,807,956 and 5,981,681; hydrophilic silicone emulsions disclosed in U.S. Pat. No. 6,207,782; and polymers made up of one or more crosslinked rake or comb silicone copolymer segments disclosed in U.S. Pat. No. 7,465,439. Additional modified silicones or silicone copolymers useful herein are described in US Patent Application Nos. 2007/0286837A1 and 2005/0048549A1.

The above-noted silicone-based quaternary ammonium compounds may be combined with the silicone polymers described in U.S. Pat. Nos. 7,041,767 and 7,217,777 and US Application number 2007/0041929A1.

The silicone may comprise amine ABn silicones and quat ABn silicones. Such silicones are generally produced by reacting a diamine with an epoxide. These are described, for example, in U.S. Pat. Nos. 6,903,061 B2, 5,981,681, 5,807,956, 6,903,061 and 7,273,837. These are commercially available under the trade names Magnasoft® Prime, Magnasoft® JSS, Silsoft® A-858 (all from Momentive Silicones).

The silicone comprising amine ABn silicones and/or quat ABn silicones may have the following structure of Formula (III):

$$D_z\text{-}(E\text{-}B)_x\text{-}A\text{-}(B\text{-}E)_x\text{-}D_z \qquad \text{Formula (III)}$$

wherein:

each index x is independently an integer from 1 to 20, from 1 to 12, from 1 to 8, or from 2 to 6, and each z is independently 0 or 1;

A has the following structure:

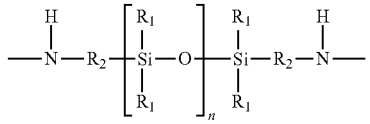

wherein:

each $R_1$ is independently a H, —OH, or $C_1$-$C_{22}$ alkyl group, in one aspect H, —OH, or $C_1$-$C_{12}$ alkyl group, H, —OH, or $C_1$-$C_2$ alkyl group, or $—CH_3$, each $R_2$ is independently selected from a divalent $C_1$-$C_{22}$ alkylene radical, a divalent $C_2$-$C_{12}$ alkylene radical, a divalent linear $C_2$-$C_8$ alkylene radical, or a divalent linear $C_3$-$C_4$ alkylene radical;

the index n is an integer from 1 to about 5,000, from about 10 to about 1,000, from about 25 to about 700, from about 100 to about 500, or from about 450 to about 500;

each B is independently selected from the following moieties:

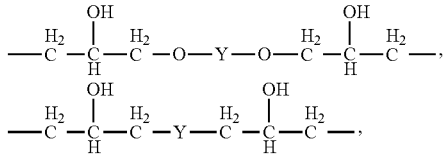

-continued

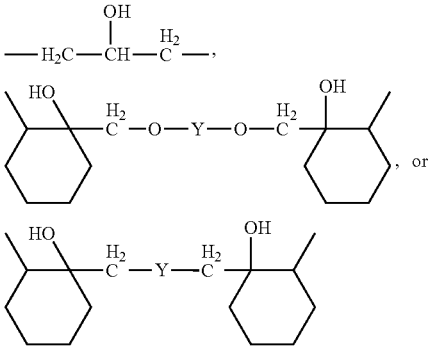

wherein for each structure, Y is a divalent $C_2$-$C_{22}$ alkylene radical that is optionally interrupted by one or more heteroatoms selected from the group consisting of O, P, S, N and combinations thereof or a divalent $C_8$-$C_{22}$ aryl alkylene radical, in one aspect a divalent $C_2$-$C_8$ alkylene radical that is optionally interrupted by one or more heteroatoms selected from the group consisting of O, P, S, N and combinations thereof or a divalent $C_8$-$C_{16}$ aryl alkylene radical, in one aspect a divalent $C_2$-$C_6$ alkylene radical that is optionally interrupted by one or more heteroatoms selected from the group consisting of O, N and combinations thereof or a divalent $C_8$-$C_{12}$ aryl alkylene radical;

each E is independently selected from the following moieties:

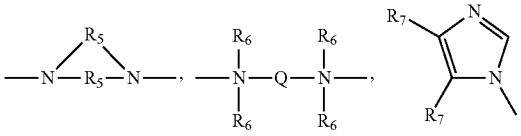

wherein:

each $R_5$ and each Q is independently selected from a divalent $C_1$-$C_{12}$ linear or branched aliphatic hydrocarbon radical that is optionally interrupted by one or more heteroatoms selected from the group consisting of O, P, S, N and combinations thereof, in one aspect a divalent $C_1$-$C_8$ linear or branched aliphatic hydrocarbon radical that is optionally interrupted by one or more heteroatoms selected from the group consisting of O, P, S, N and combinations thereof, in one aspect a divalent $C_1$-$C_3$ linear or branched aliphatic hydrocarbon radical that is optionally interrupted by one or more heteroatoms selected from the group consisting of O, N and combinations thereof;

each $R_6$ and $R_7$ is independently selected from H, $C_1$-$C_{20}$ alkyl, $C_1$-$C_{20}$ substituted alkyl, $C_6$-$C_{20}$ aryl, and $C_6$-$C_{20}$ substituted aryl, in one aspect H, $C_1$-$C_{12}$ alkyl, $C_1$-$C_{12}$ substituted alkyl, $C_6$-$C_{12}$ aryl, and $C_6$-$C_{12}$ substituted aryl, H, in one aspect $C_1$-$C_3$ alkyl, $C_1$-$C_3$ substituted alkyl, $C_6$ aryl, and $C_6$ substituted aryl, or H, with the proviso that at least one $R_6$ on each of the nitrogen atoms is H; and when E is selected from

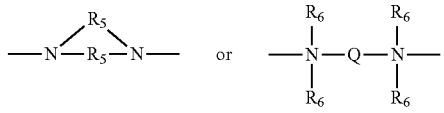

and when z is 1, the respective D is selected from H, —$CH_3$, or $R_6$; when E is

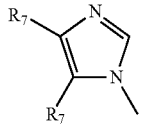

z is 0 and B is

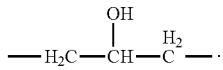

When a sample of silicone is analyzed, it is recognized by the skilled artisan that such sample may have, on average, the non-integer indices for Formulas (I)-(III) above, but that such average indices values will be within the ranges of the indices for Formulas (I)-(III) above.

Silicone Emulsion

The silicone may be added to, or is present in, the composition as an emulsion, or even a nanoemulsion. Preparation of silicone emulsions is well known to a person skilled in the art; see, for example, U.S. Pat. No. 7,683,119 and U.S. Patent Application 2007/0203263A1.

The silicone emulsion may be characterized by a mean particle size of from about 10 nm to about 1000 nm, or from about 20 nm to about 800 nm, or from about 40 nm to about 500 nm, or from about 75 nm to about 250 nm, or from about 100 nm to about 150 nm. Particle size of the emulsions is measured by means of a laser light scattering technique, using a Horiba model LA-930 Laser Scattering Particle Size Distribution Analyzer (Horiba Instruments, Inc.), according to the manufacturer's instructions.

The silicone emulsions of the present disclosure may comprise any of the aforementioned types of silicone polymers. Suitable examples of silicones that may comprise the emulsion include aminosilicones, such as those described herein.

The silicone-containing emulsion of the present disclosure may comprise from about 1% to about 60%, or from about 5% to about 40%, or from about 10% to about 30%, by weight of the emulsion, of the silicone compound.

The silicone emulsion may comprise one or more solvents. The silicone emulsion of the present disclosure may comprise from about 0.1% to about 20%, or to about 12%, or to about 5%, by weight of the silicone, of one or more solvents, provided that the silicone emulsion comprises less than about 50%, or less than about 45%, or less than about 40%, or less than about 35%, or less than about 32% of solvent and surfactant combined, by weight of the silicone. The silicone emulsion may comprise from about 1% to about 5% or from about 2% to about 5% of one or more solvents, by weight of the silicone.

The solvent may be selected from monoalcohols, polyalcohols, ethers of monoalcohols, ethers of polyalcohols, or mixtures thereof. Typically, the solvent has a hydrophilic-lipophilic balance (HLB) ranging from about 6 to about 14. More typically, the HLB of the solvent will range from about 8 to about 12, most typically about 11. One type of solvent may be used alone or two or more types of solvents may be used together. The solvent may comprise a glycol ether, an alkyl ether, an alcohol, an aldehyde, a ketone, an ester, or a mixture thereof. The solvent may be selected from a monoethylene glycol monoalkyl ether that comprises an alkyl group having 4-12 carbon atoms, a diethylene glycol monoalkyl ether that comprises an alkyl group having 4-12 carbon atoms, or a mixture thereof.

The silicone emulsion of the present disclosure may comprise from about 1% to about 40%, or to about 30%, or to about 25%, or to about 20%, by weight of the silicone, of one or more surfactants, provided that the combined weight of the surfactant plus the solvent is less than about 50%, or less than about 45%, or less than about 40%, or less than about 35%, or less than about 32%, by weight of the silicone. The silicone emulsion may comprise from about 5% to about 20% or from about 10% to about 20% of one or more surfactants, by weight of the silicone. The surfactant may be selected from anionic surfactants, nonionic surfactants, cationic surfactants, zwitterionic surfactants, amphoteric surfactants, ampholytic surfactants, or mixtures thereof, preferably nonionic surfactant. It is believed that surfactant, particularly nonionic surfactant, facilitates uniform dispersing of the silicone fluid compound and the solvent in water.

Suitable nonionic surfactants useful herein may comprise any conventional nonionic surfactant. Typically, total HLB (hydrophilic-lipophilic balance) of the nonionic surfactant that is used is in the range of about 8-16, more typically in the range of 10-15. Suitable nonionic surfactants may be selected from polyoxyalkylene alkyl ethers, polyoxyalkylene alkyl phenol ethers, alkyl polyglucosides, polyvinyl alcohol and glucose amide surfactant. Particularly preferred are secondary alkyl polyoxyalkylene alkyl ethers. Examples of suitable nonionic surfactants include C11-15 secondary alkyl ethoxylate such as those sold under the trade name Tergitol 15-S-5, Tergitol 15-S-12 by Dow Chemical Company of Midland Mich. or Lutensol XL-100 and Lutensol XL-50 by BASF, AG of Ludwigschaefen, Germany. Other preferred nonionic surfactants include $C_{12}$-$C_{18}$ alkyl ethoxylates, such as, NEODOL® nonionic surfactants from Shell, e.g., NEODOL® 23-5 and NEODOL® 26-9. Examples of branched polyoxyalkylene alkyl ethers include those with one or more branches on the alkyl chain such as those available from Dow Chemicals of Midland, Mich. under the trade name Tergitol TMN-6 and Tergiotol TMN-3. Other preferred surfactants are listed in U.S. Pat. No. 7,683,119.

The silicone emulsion of the present disclosure may comprise from about 0.01% to about 2%, or from about 0.1% to about 1.5%, or from about 0.2% to about 1%, or from about 0.5% to about 0.75% of a protonating agent. The protonating agent is generally a monoprotic or multiprotic, water-soluble or water-insoluble, organic or inorganic acid. Suitable protonating agents include, for example, formic acid, acetic acid, propionic acid, malonic acid, citric acid, hydrochloric acid, sulfuric acid, phosphoric acid, nitric acid, or a mixture thereof, preferably acetic acid. Generally, the acid is added in the form of an acidic aqueous solution. The protonating agent is typically added in an amount necessary to achieve an emulsion pH of from about 3.5 to about 7.0.

Laundry Adjuncts

The laundry detergent compositions described herein may comprise other laundry adjuncts, including cationic polymers, silicone, external structuring systems, enzymes, microencapsulates such as perfume microcapsules, soil release polymers, hueing agents, and mixtures thereof.

Cationic Polymer

In some aspects, the detergent compositions of the present disclosure comprise a cationic polymer. The detergent compositions typically comprise from about 0.01% to about 2%, or to about 1.5%, or to about 1%, or to about 0.75%, or to about 0.5%, or to about 0.3%, or from about 0.05% to about 0.25%, by weight of the detergent composition, of cationic polymer.

In some aspects, the cationic polymer consists of only one type of structural unit, i.e., the polymer is a homopolymer. In some aspects, the cationic polymer used in the present disclosure is a polymer that consists of at least two types of structural units. The structural units, or monomers, can be incorporated in the cationic polymer in a random format or in a blocky format. In some aspects, the cationic polymer comprises (i) a first structural unit; (ii) a second structural unit; and, optionally, (iii) a third structural unit. In some aspects, (i), (ii), and (iii) total to 100 mol %. In some aspects, (i) and (ii) total to 100 mol %.

In a particularly preferred embodiment of the present disclosure, the cationic polymer is a copolymer that contains only the first and second structural units as described herein, i.e., it is substantially free of any other structural components, either in the polymeric backbone or in the side chains. In another preferred embodiment of the present disclosure, such cationic polymer is a terpolymer that contains only the first, second and third structural units as described herein, substantially free of any other structural components. Alternatively, it can include one or more additional structural units besides the first, second, and third structural units described hereinabove.

In some aspects, the cationic polymer comprises a nonionic structural unit. In some aspects, the cationic polymer comprises from about 5 mol % to about 60 mol %, or from about 5% to about 45%, or from about 15 mol % to about 30 mol %, of a nonionic structural unit. In some aspects, the cationic polymer comprises a nonionic structural unit derived from a monomer selected from the group consisting of (meth)acrylamide, vinyl formamide, N,N-dialkyl acrylamide, N,N-dialkylmethacrylamide, $C_1$-$C_{12}$ alkyl acrylate, $C_1$-$C_{12}$ hydroxyalkyl acrylate, polyalkylene glycol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and mixtures thereof. Preferably, the nonionic structural unit in the cationic polymer is selected from methacrylamide, acrylamide, and mixtures thereof. Preferably, the nonionic structural unit is acrylamide.

In some aspects, the cationic polymer comprises a cationic structural unit. In some aspects, the cationic polymer comprises from about 30 mol % to about 100 mol %, or from about 50 mol % to about 100 mol %, or from about 55 mol % to about 95 mol %, or from about 70 mol % to about 85 mol %, of a cationic structural unit.

In some aspects, the cationic monomer is selected from the group consisting of N,N-dialkylaminoalkyl methacrylate, N,N-dialkylaminoalkyl acrylate, N,N-dialkylaminoalkyl acrylamide, N,N-dialkylaminoalkylmethacrylamide, methacylamidoalkyl trialkylammonium salts, acrylamidoalkylltrialkylamminium salts, vinylamine, vinylimine, vinyl imidazole, quaternized vinyl imidazole, diallyl dialkyl ammonium salts, and mixtures thereof.

Preferably, the cationic monomer is selected from the group consisting of diallyl dimethyl ammonium salts (DADMAS), N,N-dimethyl aminoethyl acrylate, N,N-dimethyl aminoethyl methacrylate (DMAM), [2-(methacryloylamino)ethyl]tri-methylammonium salts, N,N-dimethylaminopropyl acrylamide (DMAPA), N,N-dimethylaminopropyl methacrylamide (DMAPMA), acrylamidopropyl trimethyl ammonium salts (APTAS), methacrylamidopropyl trimethylammonium salts (MAPTAS), quaternized vinylimidazole (QVi), and mixtures thereof. Even more preferably, the cationic polymer comprises a cationic monomer derived from diallyl dimethyl ammonium salts (DADMAS), acrylamidopropyl trimethyl ammonium salts (APTAS), methacrylamidopropyl trimethylammonium salts (MAPTAS), quaternized vinylimidazole (QVi), and mixtures thereof. Typically, DADMAS, APTAS, and MAPTAS are salts comprising chloride (i.e. DADMAC, APTAC, and/or MAPTAC).

In some aspects, the cationic polymer comprises an anionic structural unit. The cationic polymer may comprise from about 0.01 mol % to about 10 mol %, or from about 0.1 mol % to about 5 mol %, or from about 1% to about 4% of an anionic structural unit. In some aspects, the polymer comprises 0% of an anionic structural unit, i.e., is substantially free of an anionic structural unit. In some aspects, the anionic structural unit is derived from an anionic monomer selected from the group consisting of acrylic acid (AA), methacrylic acid, maleic acid, vinyl sulfonic acid, styrene sulfonic acid, acrylamidopropylmethane sulfonic acid (AMPS) and their salts, and mixtures thereof.

In a particularly preferred embodiment of the present disclosure, the cationic polymer is a copolymer that does not contain any of the third structural unit (i.e., the third structural unit is present at 0 mol %). In another specific embodiment of the present disclosure, the cationic polymer contains the first, second, and third structural units as described hereinabove, and is substantially free of any other structural unit.

In some aspects, the detergent composition comprises a cationic polymer; where the cationic polymer comprises (i) from about 5 mol % to about 50 mol %, preferably from about 15 mol % to about 30 mol %, of a first structural unit derived from (meth)acrylamide; and (ii) from about 50 mol % to about 95 mol %, preferably from about 70 mol % to about 85 mol %, of a second structural unit derived from a cationic monomer; and where the detergent composition comprises a surfactant system comprising anionic surfactant and nonionic surfactant in a ratio of from about 1.1:1 to about 2.5:1, or from about 1.5:1 to about 2.5:1, or about 2:1.

In some aspects, the cationic polymer is selected from acrylamide/DADMAS, acrylamide/DADMAS/acrylic acid, acrylamide/APTAS, acrylamide/MAPTAS, acrylamide/QVi, polyvinyl formamide/DADMAS, poly(DADMAS), acrylamide/MAPTAC/acrylic acid, acrylamide/APTAS/acrylic acid, and mixtures thereof.

In a particularly preferred embodiment, the cationic polymer comprises a first structural unit derived from acrylamide, wherein said cationic deposition polymer further comprises a second structural unit derived from DADMAC, and wherein said first structural unit and said second structural unit are in a structural unit ratio of from about 5:95 to about 45:55, preferably from about 15:85 to about 30:70, and preferably where the cationic polymer is characterized by a weight average molecular weight of from about 5 kDaltons to about 200 kDaltons, or even from about 10 kDaltons to about 80 kDaltons.

In another particularly preferred embodiment, the cationic polymer is an acrylamide/MAPTAC polymer with a calculated cationic charge density of from about 1 meq/g to about 2 meq/g and a weight average molecular weight of from about 800 kDaltons to about 1500 kDaltons.

The specific molar percentage ranges of the first, second, and optionally third structural units of the cationic polymer as specified hereinabove may be important for optimizing the feel and whiteness profiles generated by the laundry detergent compositions containing such cationic polymer during the wash and rinse cycles.

The cationic polymers described herein have a weight average molecular weight. In some aspects, the cationic polymers described herein are characterized by a weight average molecular weight of from about 5 kDaltons to about 5000 kDaltons. In some aspects, the cationic polymers described herein have a weight average molecular weight of from about 200 kDaltons to about 5000 kDaltons, preferably from about 500 kDaltons to about 5000 kDaltons, more preferably from about 1000 kDaltons to about 3000 kDaltons.

In some aspects, the cationic polymer has a weight average molecular weight of from about 5 kDaltons to about 200 kDaltons, preferably from about 10 kDaltons to about 100 kDaltons, more preferably from about 20 kDaltons to about 50 kDaltons. Careful selection of the molecular weight of the cationic polymer has been found to be particularly effective in reducing the whiteness loss that is commonly seen in fabrics, particularly after they have been exposed to multiple washes. Cationic polymers have been known to contribute to fabric whiteness loss, which is a limiting factor for wider usage of such polymers. However, applicants have discovered that by controlling the molecular weight of the cationic polymer within a specific range, the fabric whiteness loss can be effectively improved, and feel benefits maintained or improved, in comparison with conventional cationic polymers, particular in the presence of the surfactant systems disclosed herein.

Further, product viscosity can be impacted by molecular weight and cationic content of the cationic polymer. Molecular weights of polymers of the present disclosure are also selected to minimize impact on product viscosity to avoid product instability and stringiness associated with high molecular weight and/or broad molecular weight distribution.

The cationic polymers of the present disclosure may be characterized by a calculated cationic charge density. In some aspects, the calculated charge density is from about 1 meq/g to about 12 meq/g.

In order to maintain cleaning and/or whiteness benefits in detergent compositions, it is known in the art to employ cationic polymers that have a relatively low cationic charge density, for example, less than 4 meq/g. However, it has been surprisingly found that in the present compositions, a cationic polymer with a relatively high charge density, e.g., greater than 4 meq/g may be used while maintaining good cleaning and/or whiteness benefits. Therefore, in some aspects, the cationic polymers described herein are characterized by a cationic charge density of from about 4 meq/g, or from about 5 meq/g, or from about 5.2 meq/g to about 12 meq/g, or to about 10 meq/g, or to about 8 meq/g or to about 7 meq/g, or to about 6.5 meq/g. In some aspects, the cationic polymers described herein are characterized by a cationic charge density of from about 4 meq/g to about 12 meq/g, or from about 4.5 meq/g to about 7 meq/g. An upper limit on the cationic charge density may be desired, as the viscosity of cationic polymers with cationic charge densities that are too high may lead to formulation challenges.

In some aspects, particularly when the cationic polymer has a relatively high weight average molecular weight (e.g., above 200 kDaltons), the cationic polymers described herein are characterized by a calculated cationic charge density of from about 1 meq/g, or from about 1.2 meq/g, or from about 1.5 meq/g, or from about 1.9 meq/g, to about 12 meq/g, or to about 8 meq/g, or to about 5 meq/g, or to about 4 meq/g, or to about 3 meq/g, or to about 2.5 meq/g, or to about 2.0 meq/g. In some aspects, the cationic polymers described herein are characterized by a cationic charge density of from about 1 meq/g to about 3 meq/g, or to about 2.5 meq/g, or to about 2.0 meq/g, or even to about 1.5 meq/g.

In some aspects, the cationic polymers described herein are substantially free of, or free of, any silicone-derived structural unit. It is understood that such a limitation does not preclude the detergent composition itself from containing silicone, nor does it preclude the cationic polymers described herein from complexing with silicone comprised in such detergent compositions or in a wash liquor.

Typically, the compositions of the present disclosure are free of polysaccharide-based cationic polymers, such as cationic hydroxyethylene cellulose, particularly when the compositions comprise enzymes such as cellulase, amylase, lipase, and/or protease. Such polysaccharide-based polymers are typically susceptible to degradation by cellulase enzymes, which are often present at trace levels in commercially-supplied enzymes. Thus, compositions comprising polysaccharide-based cationic polymers are typically incompatible with enzymes in general, even when cellulase is not intentionally added.

External Structuring System

When the detergent composition is a liquid composition, the detergent composition may comprise an external structuring system. The structuring system may be used to provide sufficient viscosity to the composition in order to provide, for example, suitable pour viscosity, phase stability, and/or suspension capabilities.

The composition of the present disclosure may comprise from 0.01% to 5% or even from 0.1% to 1% by weight of an external structuring system. The external structuring system may be selected from the group consisting of:

(i) non-polymeric crystalline, hydroxy-functional structurants and/or (ii) polymeric structurants.

Such external structuring systems may be those which impart a sufficient yield stress or low shear viscosity to stabilize a fluid laundry detergent composition independently from, or extrinsic from, any structuring effect of the detersive surfactants of the composition. They may impart to a fluid laundry detergent composition a high shear viscosity at 20 $s^{-1}$ at 21° C. of from 1 to 1500 cps and a viscosity at low shear (0.05 $s^{-1}$ at 21° C.) of greater than 5000 cps. The viscosity is measured using an AR 550 rheometer from TA instruments using a plate steel spindle at 40 mm diameter and a gap size of 500 μm. The high shear viscosity at 20 $s^{-1}$ and low shear viscosity at 0.5 $s^{-1}$ can be obtained from a logarithmic shear rate sweep from 0.1 $s^{-1}$ to 25 $s^{-1}$ in 3 minutes time at 21° C.

In one embodiment, the compositions may comprise from about 0.01% to about 1% by weight of a non-polymeric crystalline, hydroxyl functional structurant. Such non-polymeric crystalline, hydroxyl functional structurants may comprise a crystallizable glyceride which can be pre-emulsified to aid dispersion into the final unit dose laundry detergent composition. Suitable crystallizable glycerides include hydrogenated castor oil or "HCO" or derivatives thereof, provided that it is capable of crystallizing in the liquid detergent composition.

The detergent composition may comprise from about 0.01% to 5% by weight of a naturally derived and/or synthetic polymeric structurant. Suitable naturally derived polymeric structurants include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Suitable synthetic polymeric structurants include: polycarboxylates, polyacrylates, hydrophobically modified ethoxylated urethanes, hydrophobically modified non-ionic polyols and mixtures thereof. In one aspect, the polycarboxylate polymer may be a polyacrylate, polymethacrylate or mixtures thereof. In another aspect, the polyacrylate may be a copolymer of unsaturated mono- or di-carbonic acid and $C_1$-$C_{30}$ alkyl ester of the (meth)acrylic acid. Such copolymers are available from Noveon inc under the tradename Carbopol® Aqua 30.

Suitable structurants and methods for making them are disclosed in U.S. Pat. No. 6,855,680 and WO 2010/034736.

Enzymes

The cleaning compositions of the present disclosure may comprise enzymes. Enzymes may be included in the cleaning compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, carbohydrases, cellulases, oxidases, peroxidases, mannanases, and mixtures thereof of any suitable origin, such as vegetable, animal, bacterial, fungal, and yeast origin. Other enzymes that may be used in the cleaning compositions described herein include hemicellulases, gluco-amylases, xylanases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidases, chondroitinases, laccases, or mixtures thereof. Enzyme selection is influenced by factors such as pH-activity and/or stability optima, thermostability, and stability to active detergents, builders, and the like.

In some aspects, lipase may be included. Additional enzymes that may be used in certain aspects include mannanase, protease, and cellulase. Mannanase, protease, and cellulase may be purchased under the trade names, respectively, Mannaway, Savinase, and Celluclean, from Novozymes (Denmark), providing, respectively, 4 mg, 15.8 mg, and 15.6 mg active enzyme per gram.

In some aspects, the composition comprises at least two, or at least three, or at least four enzymes. In some aspects, the composition comprises at least an amylase and a protease.

Enzymes are normally incorporated into cleaning compositions at levels sufficient to provide a "cleaning-effective amount." The phrase "cleaning effective amount" refers to any amount capable of producing a cleaning, stain removal, soil removal, whitening, deodorizing, or freshness improving effect on soiled material such as fabrics, hard surfaces, and the like. In some aspects, the detergent compositions may comprise from about 0.0001% to about 5%, or from about 0005% to about 3%, or from about 0.001% to about 2%, of active enzyme by weight of the cleaning composition. The enzymes can be added as a separate single ingredient or as mixtures of two or more enzymes.

A range of enzyme materials and means for their incorporation into synthetic cleaning compositions is disclosed in WO 9307263 A; WO 9307260 A; WO 8908694 A; U.S. Pat. Nos. 3,553,139; 4,101,457; and U.S. Pat. No. 4,507,219. Enzyme materials useful for liquid cleaning compositions, and their incorporation into such compositions, are disclosed in U.S. Pat. No. 4,261,868.

Microencapsulates and Delivery Systems

In some aspects, the composition disclosed herein may comprise microencapsulates. The microencapsulates may comprise a suitable benefit agent such as perfume raw materials, silicone oils, waxes, hydrocarbons, higher fatty acids, essential oils, lipids, skin coolants, vitamins, sunscreens, antioxidants, glycerine, catalysts, bleach particles, silicon dioxide particles, malodor reducing agents, odor-controlling materials, chelating agents, antistatic agents, softening actives, insect and moth repelling agents, colorants, antioxidants, chelants, bodying agents, drape and form control agents, smoothness agents, wrinkle control agents, sanitization agents, disinfecting agents, germ control agents, mold control agents, mildew control agents, antiviral agents, drying agents, stain resistance agents, soil release agents, fabric refreshing agents and freshness extending agents, chlorine bleach odor control agents, dye fixatives, dye transfer inhibitors, color maintenance agents, optical brighteners, color restoration/rejuvenation agents, anti-fading agents, whiteness enhancers, anti-abrasion agents, wear resistance agents, fabric integrity agents, anti-wear agents, anti-pilling agents, defoamers, anti-foaming agents, UV protection agents, sun fade inhibitors, anti-allergenic agents, enzymes, water proofing agents, fabric comfort agents, shrinkage resistance agents, stretch resistance agents, stretch recovery agents, skin care agents, glycerin, and natural actives, antibacterial actives, antiperspirant actives, cationic polymers, dyes and mixtures thereof. In some aspects, the microencapsulate is a perfume microcapsule as described below.

In some aspects, the compositions disclosed herein may comprise a perfume delivery system. Suitable perfume delivery systems, methods of making certain perfume delivery systems, and the uses of such perfume delivery systems are disclosed in USPA 2007/0275866 A1. Such perfume delivery system may be a perfume microcapsule. The perfume microcapsule may comprise a core that comprises perfume and a shell, with the shell encapsulating the core. The shell may comprise a material selected from the group consisting of aminoplast copolymer, an acrylic, an acrylate, and mixtures thereof. The aminoplast copolymer may be melamine-formaldehyde, urea-formaldehyde, cross-linked melamine formaldehyde, or mixtures thereof. In some aspects, the shell comprises a material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate and mixtures thereof. The perfume microcapsule's shell may be coated with one or more materials, such as a polymer, that aids in the deposition and/or retention of the perfume microcapsule on the site that is treated with the composition disclosed herein. The polymer may be a cationic polymer selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, poly vinyl amine, copolymers of poly vinyl amine and N-vinyl formamide, and mixtures thereof. Typically, the core comprises raw perfume oils. The perfume microcapsule may be friable and/or have a mean particle size of from about 10 microns to about 500 microns or from about 20 microns to about 200 microns. In some aspects, the composition comprises, based on total composition weight, from about 0.01% to about 80%, or from about 0.1% to about 50%, or from about 1.0% to about 25%, or from about 1.0% to about 10% of perfume microcapsules. Suitable capsules may be obtained from Appleton Papers Inc., of Appleton, Wis. USA.

Formaldehyde scavengers may also be used in or with such perfume microcapsules. Suitable formaldehyde scavengers may include: sodium bisulfite, urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly(vinyl alcohol), poly(vinyl amine), hexane diol, ethylenediamine-N,N'-bisacetoacetamide, N-(2-ethylhexyl)acetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, benzylamine, hydroxycitronellol, cyclohexanone, 2-butanone, pentane dione, dehydroacetic acid, chitosan, or a mixture thereof.

Suitable encapsulates and benefit agents are discussed further in U.S. Patent Application 2008/0118568A1, US2011/026880, US2011/011999, 2011/0268802A1, and US20130296211, each assigned to The Procter & Gamble Company and incorporated herein by reference.

Soil Release Polymers (SRPs)

The detergent compositions of the present disclosure may comprise a soil release polymer. In some aspects, the detergent compositions may comprise one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN300 and SRN325 supplied by Clariant. Other suitable soil release polymers are Marloquest polymers, such as Marloquest SL supplied by Sasol.

Hueing Agents

The compositions may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes such as those described in EP1794275 or EP1794276, or dyes as disclosed in U.S. Pat. No. 7,208,459 B2, and mixtures thereof. In another aspect, suitable small molecule dyes include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes include those described in WO2011/98355, WO2011/47987, US2012/090102, WO2010/145887, WO2006/055787 and WO2010/142503. In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenylmethane polymeric colourants, alkoxylated thiophene polymeric colourants, and mixtures thereof.

Preferred hueing dyes include the whitening agents found in WO 08/87497 A1, WO2011/011799 and WO2012/054835. Preferred hueing agents for use in the present disclosure may be the preferred dyes disclosed in these references, including those selected from Examples 1-42 in Table 5 of WO2011/011799. Other preferred dyes are disclosed in U.S. Pat. No. 8,138,222. Other preferred dyes are disclosed in WO2009/069077.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect, suitable pigments include pigments selected from the group consisting of Ultramarine Blue (C.I. Pigment Blue 29), Ultramarine Violet (C.I. Pigment Violet 15) and mixtures thereof.

The aforementioned fabric hueing agents can be used in combination (any mixture of fabric hueing agents can be used).

Other Laundry Adjuncts

The detergent compositions described herein may comprise other conventional laundry adjuncts. Suitable laundry adjuncts include builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, for example PEI600 EO20 (ex BASF), polymeric soil release agents, polymeric dispersing agents, polymeric grease cleaning agents, brighteners, suds suppressors, dyes, perfume, structure elasticizing agents, fabric softeners, carriers, fillers, hydrotropes, solvents, anti-microbial agents and/or preservatives, neutralizers and/or pH adjusting agents, processing aids, opacifiers, pearlescent agents, pigments, or mixtures thereof. Typical usage levels range from as low as 0.001% by weight of composition for adjuncts such as optical brighteners and sunscreens to 50% by weight of composition for builders. Suitable adjuncts are described in U.S. patent application Ser. No. 14/226,878, and U.S. Pat. Nos. 5,705,464, 5,710,115, 5,698,504, 5,695,679, 5,686,014 and 5,646,101, each of which is incorporated herein by reference.

Softener Composition

The method described herein comprises a rinsing step, where a fabric is contacted with a softener composition, where the softener composition comprises a fabric softening active (FSA). Suitable softener compositions are described below.

Form

The softener compositions of the present disclosure may take any suitable form, such as liquid, gel, foam, or solid (such as beads, for example those described in U.S. Pat. No. 7,867,968, or a dryer machine bar), or the composition may be used in combination with a flexible substrate, e.g., a dryer sheet, such as those described in U.S. Pat. No. 5,102,564, U.S. Pat. No. 5,578,234, U.S. Pat. No. 5,470,492, WO1999/015611, USPA 2007/0270327A1, each of which is incorporated herein by reference.

Typically, the softener composition is a liquid. In some aspects, the softener compositions comprise from about 60% to about 95%, preferably from about 65% to about 90%, by weight of the softener composition, of an aqueous liquid carrier. The preferred aqueous carrier is water, which can contain minor ingredients.

Suitable commercially available fabric softeners may also be used, such DOWNY® and LENOR® (both available from The Procter & Gamble Company), as well as SNUGGLE® (available from The Sun Products Corporation).

Fabric Softening Active (FSA)

The softener compositions described herein comprise a fabric softening active ("FSA"). The term "fabric softening active" or "FSA" is used herein in the broadest sense to include any active that is suitable for softening a fabric. In some aspects, the softener compositions comprise, based on total softener composition weight, from about 2% to about 25%, or from about 3% to about 15%, or even from about 3% to about 7% of one or more fabric softening actives. In some aspects, the fabric softening active is a cationic fabric softening active. Typical fabric softening actives are described below.

In some aspects, the FSA of the methods described herein comprises a quaternary ammonium compound, silicone, fatty acids or esters, sugars, fatty alcohols, alkoxylated fatty alcohols, polyglycerol esters, oily sugar derivatives, wax emulsions, fatty acid glycerides, or mixtures thereof.

In some aspects, the FSA is a quaternary ammonium compound suitable for softening fabric in a rinse step. In one embodiment, the FSA is formed from a reaction product of a fatty acid and an aminoalcohol obtaining mixtures of mono-, di-, and, in one embodiment, triester compounds. In aspects, the FSA comprises one or more softener quaternary ammonium compounds such, but not limited to, as a monoalkylquaternary ammonium compound, dialkylquaternary ammonium compound, a diamido quaternary compound, a diester quaternary ammonium compound, a monoester quaternary ammonium compound or a combination thereof.

In some aspects, the FSA comprises a quaternary ammonium compound selected from the group consisting of:

a) linear quaternary ammonium compounds;
b) branched quaternary ammonium compounds;
c) cyclic quaternary ammonium compounds;
d) and mixtures thereof;

where the quaternary ammonium compounds comprise:

one or more $C_{10}$-$C_{22}$ fatty acid moieties, $C_{16}$-$C_{20}$ fatty acid moieties, or $C_{16}$-$C_{18}$ fatty acid moieties, said fatty acid moieties having an Iodine Value from 0 to about 95, preferably from 0 to about 35, preferably from 0 to about 20;

a counter ion; and one or more moieties selected from the group consisting of alkyl moieties, ester moieties, amide moieties, and ether moieties said one or more moieties being covalently bound to the nitrogen of said quaternary ammonium compound.

The Iodine Value (IV) is the amount of iodine in grams consumed by the reaction of the double bonds of 100 g of fatty acid, determined by the method of ISO 3961.

Exemplary quaternary ammonium compounds include, but are not limited to, alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. Examples of fabric softener actives are described in U.S. Pat. No. 7,381,697, column 3, line 43—column 4, line 67, and in U.S. Pat. No. 7,135,451, column 5, line 1—column 11, line 40, and US 2011/0239377 A1. See also U.S. Pat. Nos. 4,424,134; 4,767,547; 5,545,340; 5,545,350; 5,562,849; and 5,574,179.

In some aspects, the FSA comprises compounds of the following formula:

$$\{R_{4-m}—N^+—[Z—Y—R^1]_n\}A^- \quad (1)$$

wherein each R comprises either hydrogen, a short chain $C_1$-$C_6$ alkyl or hydroxyalkyl group, and in one aspect a $C_1$-$C_3$ alkyl or hydroxyalkyl group, for example methyl, ethyl, propyl, hydroxyethyl, and the like, poly($C_{2-3}$ alkoxy), polyethoxy, benzyl, or mixtures thereof; each Z is independently $(CH_2)n$, $CH_2$—$CH(CH_3)$— or CH—$(CH_3)$—$CH_2$—; each Y may comprise —O—(O)C—, —C(O)—O—, —NR—C(O)—, or —C(O)—NR—; each m is 2 or 3; each n is from 1 to about 3, in one aspect 2; the sum of carbons in each $R^1$, plus one when Y is —O—(O)C— or —NR—

C(O)—, may be $C_{12}$-$C_{22}$, or $C_{14}$-$C_{20}$, with each $R^1$ being a hydrocarbyl, or substituted hydrocarbyl group; and $A^-$ may comprise any softener-compatible anion. In one aspect, the softener-compatible anion may comprise chloride, bromide, methylsulfate, ethylsulfate, sulfate, and nitrate. In another aspect, the softener-compatible anion may comprise chloride or methyl sulfate. As used herein, when the diester is specified, it can include the monoester that is present.

In some aspects, the fabric softening active may comprise a diester quaternary amine (DEQA) of the general formula:

$$[R_3N^+CH_2CH(YR^1)(CH_2YR^1)]A^-$$

wherein each Y, R, $R^1$, and $A^-$ has the same meanings as before. Such compounds include those having the formula:

$$[CH_3]_3N^{(+)}[CH_2CH(CH_2O(O)CR^1)O(O)CR^1]Cl^{(-)} \quad (2)$$

wherein each R may comprise a methyl or ethyl group. In one aspect, each $R^1$ may comprise a $C_{15}$ to $C_{19}$ group. As used herein, when the diester is specified, it can include the monoester that is present.

These types of agents and general methods of making them are disclosed in U.S. Pat. No. 4,137,180. An example of a suitable DEQA (2) is the "propyl" ester quaternary ammonium fabric softener active comprising the formula 1,2-di(acyloxy)-3-trimethylammoniumpropane chloride.

In some aspects, the fabric softening active comprises compounds of the formula:

$$[R_{4-m}—N^+—R^1{}_m]A^- \quad (3)$$

wherein each R, $R^1$, m and $A^-$ has the same meanings as before.

In some aspects, the fabric softening active comprises compounds of the formula:

(4)

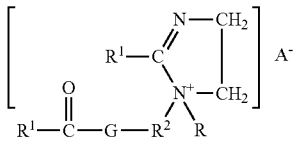

wherein each R, $R^1$, and $A^-$ have the definitions given above; $R^2$ may comprise a $C_{1-6}$ alkylene group, in one aspect an ethylene group; and G may comprise an oxygen atom or an —NR— group; and A- is chloride, bromide, iodide, methylsulfate, ethylsulfate, acetate, formate, sulfate, carbonate, and the like.

In some aspects, the fabric softening active comprises compounds of the formula:

(5)

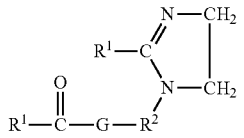

wherein $R^1$, $R^2$ and G are defined as above.

In some aspects, the fabric softening active comprises condensation reaction products of fatty acids with dialkylenetriamines in, e.g., a molecular ratio of about 2:1, said reaction products containing compounds of the formula:

$$R^1—C(O)—NH—R^2—NH—R^3—NH—C(O)—R^1 \quad (6)$$

wherein $R^1$, $R^2$ are defined as above, and $R^3$ may comprise a $C_{1-6}$ alkylene group, preferably an ethylene group and wherein the reaction products may optionally be quaternized by the additional of an alkylating agent such as dimethyl sulfate. Such quaternized reaction products are described in additional detail in U.S. Pat. No. 5,296,622.

In some aspects, the fabric softening active comprises compounds of the formula:

$$[R^1—C(O)—NR—R^2—N(R)_2—R^3—NR—C(O)—R^1]^+A^- \quad (7)$$

wherein R, $R^1$, $R^2$, $R^3$ and $A^-$ are defined as above.

In some aspects, the fabric softening active comprise reaction products of fatty acid with hydroxyalkylalkylenediamines in a molecular ratio of about 2:1, said reaction products containing compounds of the formula:

$$R^1—C(O)—NH—R^2—N(R^3OH)—C(O)—R^1 \quad (8)$$

wherein $R^1$, $R^2$ and $R^3$ are defined as above;

In some aspects, the fabric softening active comprises compounds of the formula:

(9)

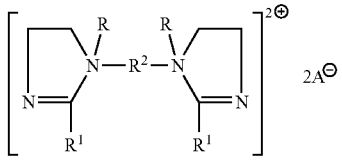

wherein R, $R^1$, $R^2$, and $A^-$ are defined as above.

In some aspects, the fabric softening active comprises compounds of the formula:

(10)

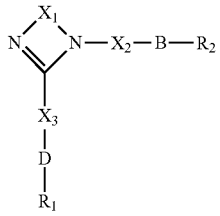

wherein $X_1$ is a C2-3 alkyl group, preferably an ethyl group;

$X_2$ and $X_3$ are independently C1-6 linear or branched alkyl or alkenyl groups, preferably methyl, ethyl or isopropyl groups;

$R_1$ and $R_2$ are independently C8-22 linear or branched alkyl or alkenyl groups;

characterized in that B and D are independently selected from the group comprising —O—(C=O)—, —(C=O)—O—, or mixtures thereof, preferably -0-(C=0)-.

Non-limiting examples of fabric softening actives comprising formula (1) are N, N-bis(stearoyl-oxy-ethyl)-N,N-dimethyl ammonium chloride, N,N-bis(tallowoyl-oxy-ethyl)-N,N-dimethyl ammonium chloride, N,N-bis-(stearoyl-2-hydroxypropyl)-N,N-dimethylammonium methylsulphate, N,N-bis-(tallowoyl-2-hydroxypropyl)-N,N-dimethylammonium methylsulphate, N,N-bis-(palmitoyl-2-hydroxypropyl)-N,N-dimethylammonium methylsulphate, N,N-bis-(stearoyl-2-hydroxypropyl)-N,N-dimethylammonium chloride, N,N-bis(stearoyl-oxy-ethyl)-N-(2 hydroxyethyl)-N-methyl ammonium methylsulfate.

Non-limiting examples of fabric softening actives comprising formula (2) is 1, 2 di (stearoyl-oxy) 3 trimethyl ammoniumpropane chloride.

Non-limiting examples of fabric softening actives comprising formula (3) include dialkylenedimethylammonium salts such as dicanoladimethylammonium chloride, di(hard) tallowdimethylammonium chloride dicanoladimethylammonium methylsulfate. An example of commercially available dialkylenedimethylammonium salts usable in the present invention is dioleyldimethylammonium chloride available from Evonik Industries under the trade name Adogen® 472 and dihardtallow dimethylammonium chloride available from Akzo Nobel Arquad 2HT75.

A non-limiting example of fabric softening actives comprising formula (4) is 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from the Evonik Industries under the trade name Varisoft®.

A non-limiting example of fabric softening actives comprising formula (5) is 1-tallowylamidoethyl-2-tallowylimidazoline wherein $R^1$ is an acyclic aliphatic $C_{15}$-$C_{17}$ hydrocarbon group, $R^2$ is an ethylene group, and G is a NH group.

A non-limiting example of a fabric softening active comprising formula (6) is the reaction products of fatty acids with diethylenetriamine in a molecular ratio of about 2:1, said reaction product mixture containing N,N"-dialkyldiethylenetriamine with the formula:

$$R^1—C(O)—NH—CH_2CH_2—NH—CH_2CH_2—NH—C(O)—R^1$$

wherein $R^1$ is an alkyl group of a commercially available fatty acid derived from a vegetable or animal source, such as Emersol® 223LL or Emersol® 7021, available from Henkel Corporation, and $R^2$ and $R^3$ are divalent ethylene groups.

A non-limiting example of Compound (7) is a difatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$ is an alkyl group. An example of such compound is that commercially available from the Evonik Industries e.g. under the trade name Varisoft® 222LT.

An example of a fabric softening active comprising formula (8) is the reaction products of fatty acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source, such as Emersol® 223LL or Emersol® 7021, available from Henkel Corporation.

An example of a fabric softening active comprising formula (9) is the diquaternary compound having the formula:

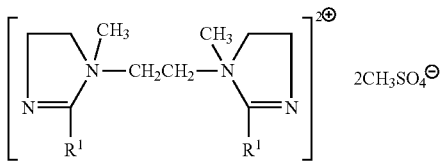

wherein $R^1$ is derived from fatty acid. Such compound is available from Evonik Industries.

A non-limiting example of a fabric softening active comprising formula (10) is a dialkyl imidazoline diester compound, where the compound is the reaction product of N-(2-hydroxyethyl)-1,2-ethylenediamine or N-(2-hydroxyisopropyl)-1,2-ethylenediamine with glycolic acid, esterified with fatty acid, where the fatty acid is (hydrogenated) tallow fatty acid, palm fatty acid, hydrogenated palm fatty acid, oleic acid, rapeseed fatty acid, hydrogenated rapeseed fatty acid or a mixture of the above.

It will be understood that combinations of softener actives disclosed above are suitable for use in this invention.

Anion A—

In the cationic nitrogenous salts described herein, the anion $A^-$, which comprises any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. In one aspect, the anion A may comprise chloride or methylsulfate. The anion, in some aspects, may carry a double charge. In this aspect, $A^-$ represents half a group. In some aspects, the fabric softening active comprises a silicone, as described above. Preferred silicones include polydimethylsilicone (PDMS), aminosilicone, silicone polyether, cationic silicones, silicone polyurethane, silicone polyureas, or mixtures thereof and mixtures thereof.

Softener Adjuncts

Typically, the softener compositions described herein comprise softener adjuncts. In some aspects, the softener composition comprises a softener adjunct selected from a salt, a cationic polymer, perfume and/or a perfume delivery system, another softener adjunct ingredient listed herein, or mixtures thereof.

In some aspects, the softener composition comprises, based on total softener composition weight, from about 0% to about 0.75%, from about 0% to about 0.5%, from about 0.01% to about 0.2%, from about 0.02% to about 0.1% or even from about 0.03% to about 0.075% of a salt. In one aspect of the softener composition, the salt may be selected from the group consisting of sodium chloride, potassium chloride, calcium chloride, magnesium chloride and mixtures thereof.

In some aspects, the softener composition comprises from about 0.01% to about 20%, from about 0.1% to about 15%, or from about 0.15% to about 10%, based on total weight of the composition, of a cationic polymer. In some aspects of the softener composition, the cationic polymer may be selected from the group consisting of polyethyleneimine, alkoxylated polyethyleneimine; alkyl polyethyleneimine and quaternized polyethyleneimine, poly(vinylamine), poly(vinylformamide)-co-poly(vinylamine), poly(vinylamine)-co-poly(vinyl alcohol) poly(diallyldimethylammonium chloride), poly(acrylamide-co-diallyldimethylammonium chloride), poly(acrylamide-methacrylamidopropyltrimethyl ammonium chloride), poly(acrylamide-co-N,N-dimethyl aminoethyl acrylate), poly(acrylamide-co-N,N, N-trimethyl aminoethyl acrylate), poly(N,N-dimethyl aminoethyl acrylate), poly(N,N,N-trimethyl aminoethyl acrylate), poly(N,N-dimethyl aminoethyl methacrylate), poly(N,N, N-trimethyl aminoethyl methacrylate), poly(acrylamide-co-N,N-dimethylaminoethyl methacrylate), poly(acrylamide-co-N,N, N-trimethylaminoethyl methacrylate), poly(hydroxyethylacrylate-co-dimethyl aminoethyl methacrylate), poly(hydroxyethylacrylate-co-trimethyl aminoethyl methacrylate), poly(hydroxpropylacrylate-co-methacrylamidopropyltrimethylammonium chloride), poly(acrylamide-co-diallyldimethylammonium chloride-co-acrylic acid), poly(acrylamide-methacrylamidopropyltrimethyl ammonium chloride-co-acrylic acid), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(acrylate-co-methacrylamidopropyltrimethylammonium, poly(methacrylate-co-methacrylamidopropyltrimethylammonium, poly(diallyldimethylammonium chloride-co-acrylic acid), poly(vinyl pyrrolidone-co-quaternized vinyl imidazole), and mixtures thereof.

In some aspects, the softener compositions described herein comprise perfume and/or a perfume delivery system, for example as described above. Preferred perfume delivery systems include perfume microcapsules.

The softener compositions described herein may comprise other softener adjunct ingredients, for example a softener adjunct ingredient selected from the group consisting of solvents, chelating agents, dye transfer inhibiting agents, dispersants, polymeric dispersing agents, clay soil removal/anti-redeposition agents, brighteners, suds suppressors, dyes, perfume, benefit agent delivery systems, structure elasticizing agents, carriers, hydrotropes, processing aids and/or pigments, cationic starches, scum dispersants, dye, hueing agent, optical brighteners, antifoam agents, stabilizer, pH control agent, metal ion control agent, odor control agent, preservative, antimicrobial agent, chlorine scavenger, anti-shrinkage agent, fabric crisping agent, spotting agent, anti-oxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, drying agent, stain resistance agent, soil release agent, malodor control agent, fabric refreshing agent, dye fixative, color maintenance agent, color restoration/rejuvenation agent, anti-fading agent, anti-abrasion agent, wear resistance agent, fabric integrity agent, anti-wear agent, and rinse aid, UV protection agent, sun fade inhibitor, insect repellent, anti-allergenic agent, enzyme, flame retardant, water proofing agent, fabric comfort agent, water conditioning agent, shrinkage resistance agent, stretch resistance agent, and mixtures thereof.

Multi-Component Fabric Treatment System

In some aspects, the present disclosure relates to a multi-component fabric treatment system, where the system comprises a first component comprising a detergent composition as described herein, and where the system further comprises a second component comprising a softener composition as described herein.

In some aspects, the first component further comprises a first container that contains the detergent composition. In some aspects, the second component further comprises a second container that contains the softener composition. The first and second containers may be of any suitable type, for example, bottles, boxes, pouches, or compartments of a multi-compartmented pouch. In some aspects, the pouches may be water soluble and may be formed of water-soluble film, such as polyvinyl alcohol (PVA) film. Preferred films are those supplied by Monosol under the trade references M8630, M8900, M8779, M9467, M8310, films described in U.S. Pat. No. 6,166,117, U.S. Pat. No. 6,787,512, USPA 2011/0188784, and PVA films of corresponding solubility and deformability characteristics. Further preferred films are those described in US 2006/0213801, WO 2010/119022, and U.S. Pat. No. 6,787,512.

In some aspects, the first component and the second component are proximal to each other. As used herein, "proximal" is understood to mean physically near, for example, separated by no more than about 100 centimeters, or by no more than about 50 centimeters, or by no more than about 10 centimeters, or by no more than about 2 centimeters, or by no more than 0.1 centimeters (e.g, in contact or nearly in contact with each other). For example, the first component and the second component may be proximal to each other on a shelf or in a display and may form an array. In some aspects, the proximal first and second components are contained in a single package, e.g., in a box or a tub. In some aspects, the first component and the second component are each in the form of unitized dose pouches, which may be packaged together in a single package, such as a tub. In such cases, the first component pouches and the second component pouches preferably comprise a signal, for example differing colors or labels, that allow a consumer to distinguish between the two types of pouches.

In some aspects, the proximal first and second components are connected. For example, the first and second components may be contained in separate parts of a single package, for example in a multi-chambered bottle or a multi-compartmented pouch. In some aspects, the first and second components are contained in a multi-compartmented pouch, where the detergent composition is contained in a first compartment and where the softener composition is contained in a second compartment. In such cases, the first and second compartments may have different rates of dissolution; preferably, the first compartment dissolves faster than the second compartment, thereby releasing the detergent composition before the fabric softener composition is released.

In some aspects, the first and second components are removeably connected; in some aspects, the first and second components, once removed, are able to be reconnected. For example, the first and second components may be connected by common outerwrap, e.g. shrink-wrap. In other embodiments, the system comprises connected first and second components in the form of pouches or sachets that may be physically separated into by a vendor or consumer, for example by tearing along a line of perforation.

The first component and the second component may be complementary to each other. For example, the components may be identical, similar, or related in terms of color, shape, and/or graphics. In some aspects, the first container (or a surface of the first container) may be complementary in shape to the second container (or to a surface of the second container), e.g., the containers can be mated, nested, or give the visual impression of being a single article when adjacent.

Test Methods

The following section describes the test methods used in the present disclosure.

Determining Weight Average Molecular Weight

The weight-average molecular weight (Mw) of a polymer material of the present invention is determined by Size Exclusion Chromatography (SEC) with differential refractive index detection (RI). One suitable instrument is Agilent® GPC-MDS System using Agilent® GPC/SEC software, Version 1.2 (Agilent, Santa Clara, USA). SEC separation is carried out using three hydrophilic hydroxylation polymethyl methacrylate gel columns (Ultrahydrogel 2000-250-120 manufactured by Waters, Milford, USA) directly joined to each other in a linear series and a solution of 0.1M sodium chloride and 0.3% trifluoroacetic acid in DI-water, which is filtered through 0.22 μm pore size GVWP membrane filter (MILLIPORE, Massachusetts, USA). The RI detector needs to be kept at a constant temperature of about 5-10° C. above the ambient temperature to avoid baseline drift. It is set to 35° C. The injection volume for the SEC is 100 μL. Flow rate is set to 0.8 ml/min. Calculations and calibrations for the test polymer measurements are conducted against a set of 10 narrowly distributed Poly(2-vinylpyridin) standards from Polymer Standard Service (PSS, Mainz Germany) with peak molecular weights of: Mp=1110 g/mol; Mp=3140 g/mol; Mp=4810 g/mol; Mp=11.5 k g/mol; Mp=22 k g/mol; Mp=42.8 k g/mol; Mp=118 k g/mol; Mp=256 k g/mol; Mp=446 k g/mol; and Mp=1060 k g/mol.

Each test sample is prepared by dissolving the concentrated polymer solution into the above-described solution of 0.1M sodium chloride and 0.3% trifluoroacetic acid in DI water, to yield a test sample having a polymer concentration of 1 to 2 mg/mL. The sample solution is allowed to stand for 12 hours to fully dissolve, and then stirred well and filtered through a 0.45 μm pore size nylon membrane (manufactured by WHATMAN, UK) into an auto sampler vial using a 5 mL syringe. Samples of the polymer standards are prepared in a similar manner. Two sample solutions are prepared for each test polymer. Each solution is measured once. The two measurement results are averaged to calculate the Mw of the test polymer.

For each measurement, the solution of 0.1M sodium chloride and 0.3% trifluoroacetic acid in DI water is first injected onto the column as the background. A correction sample (a solution of 1 mg/mL polyethylene oxide with Mp=111.3 k g/mol) is analysed six times prior to other sample measurements, so as to verify repeatability and accuracy of the system.

The weight-average molecular weight (Mw) of the test sample polymer is calculated using the software that accompanies the instrument and selecting the menu options appropriate for narrow standard calibration modelling. A third-order polynomial curve is used to fit the calibration curve to the data points measured from the Poly(2-vinylpyridin) standards. The data regions used for calculating the weight-average molecular weight are selected based upon the strength of the signals detected by the RI detector. Data regions where the RI signals are greater than 3 times the respective baseline noise levels are selected and included in the Mw calculations. All other data regions are discarded and excluded from the Mw calculations. For those regions which fall outside of the calibration range, the calibration curve is extrapolated for the Mw calculation.

To measure the average molecular weight of a test sample containing a mixture of polymers of different molecular weights, the selected data region is cut into a number of equally spaced slices. The height or Y-value of each slice from the selected region represents the abundance (Ni) of a specific polymer (i), and the X-value of each slice from the selected region represents the molecular weight (Mi) of the specific polymer (i). The weight average molecular weight (Mw) of the test sample is then calculated based on the equation described hereinabove, i.e., Mw=(Σi Ni Mi2)/(Σi Ni Mi).

Silicone Deposition Test Method

Silicone deposition on fabric is measured according to the following test method. Typically, greater silicone deposition correlates with softer-feeling fabric. Silicone deposition is characterized on 100% cotton terry towels (ex Calderon, Indianapolis, Ind., USA) or 50%/50% Polyester/Cotton Jersey Knit (ex Test Fabrics, West Pittston, Pa., USA, 147 grams/meter$^2$) that have been prepared with the method of treating a fabric, where the method comprises a washing step and a rinsing step using detergent and fabric softener compositions of the present disclosure, according to the procedures described below.

Treatment of Fabrics

Before testing for silicone deposition, the test fabrics are prepared and treated according to one of the procedures described below. Fabrics are typically "stripped" of any manufacturer's finish that may be present, dried, and then treated with a detergent composition and a fabric softening composition.

Stripping can be achieved by washing new fabrics several times in a front-loading washing machine such as a Milnor model number 30022X8J. For stripping, each load includes 45-50 pounds of fabric, and each wash cycle uses approximately 25 gallons of water with 0 mg/L of calcium carbonate equivalents hardness and water temperature of 60° C. The machine is programmed to fill and drain 15 times for a total of 375 gallons of water. The first and second wash cycles contain 175 g of AATCC nil brightener liquid laundry detergent (2003 Standard Reference Liquid Detergent WOB (without optical brightener), such as from Testfabrics Inc., West Pittston, Pa., USA). Each wash cycle is followed by two rinses, and the second wash cycle is followed by three additional wash cycles without detergent or until no suds are observed. The fabrics are then dried in a tumble dryer until completely dry, and used in the fabric treatment method.

For the fabric treatment, a North-American-style top loading machine (a Kenmore 80 series) is used. Each washing machine contains 2.5 kg of fabric including 100% cotton terry towels (~12 fabrics that are 30.5 cm×30.5 cm, RN37002LL available from Calderon Textiles, LLC 6131 W 80th St Indianapolis Ind. 46278), and 50/50 Polyester/cotton jersey knit fabrics #7422 (~10 fabric swatches, 30.5 cm×30.5 cm, available from Test Fabrics 415 Delaware Ave, West Pittston Pa. 18643), and two 100% cotton t-shirts (Gildan, size large). The stripped fabrics are treated with the compositions of the present disclosure by washing using a medium fill, 17 gallon setting with a 90° F. Wash and 60° F. Rinse using the heavy duty cycle in the Kenmore 80 series (water hardness is from 3 to 8 grains per gallon). The detergent composition (from 50 g to 100 g), is added to the water at the beginning of the cycle, followed by the fabric, then the fabric softener composition (from 20 g to 100 g), if any, is added at the beginning of the rinse cycle. If no fabric softener composition is added, it is described as a "clear rinse". Fabrics are dried using for example, a Kenmore series dryer, on the cotton/high setting for 50 min. The fabrics are treated for a total of 3 wash-dry cycles, then are analyzed for silicone deposition.

Silicone Deposition Analysis

After three treatment cycles as described above, treated fabrics (e.g., cotton terry towels; minimum n=3 per test treatment) are die-cut into 4 cm diameter circles and each circle is added to a 20 mL scintillation vial (ex VWR #66021-533) and the fabric weight is recorded. To this vial is added 12 mL of 50% Toluene/50% Methyl isobutyl ketone solvent mixture to extract non-polar silicones (eg. PDMS), or 9 mL of 15% Ethanol/85% Methyl isobutyl ketone solvent mixture is used to extract polar silicones (eg. amino-functionalized silicones). The vial containing the fabric and solvent is re-weighed, and then is agitated on a pulsed vortexer (DVX-2500, VWR #14005-826) for 30 minutes.

The silicone in the extract is quantified using inductively coupled plasma optical emission spectrometry (ICP-OES, Perkin Elmer Optima 5300DV) relative to a calibration curve and is reported in micrograms of silicone per gram of fabric. The calibration curve is prepared using ICP calibration standards of known silicone concentration that are made using the same or a structurally comparable type of silicone raw material as the products being tested. The working range of the method is 8-2300 μg silicone per gram of fabric. Typically, at least 80 micrograms/gram of silicone deposition is required to be considered to be consumer noticeable.

The Silicone Deposition Index ("SDI") is calculated by dividing the actual amount of silicone deposited on the fabric (determined by the method described herein) by the maximum theoretical amount of silicone that could have been delivered, expressed as a percentage. For example, the Silicone Deposition Index can be calculated according to the following equation:

SDI={(actual silicone deposition)/[(total g silicone added per cycle)/g fabric in load)×no. of cycles]}×100 where silicone may be expressed in grams or micrograms, and where the mass of the fabric load (measured dry) is expressed in grams.

EXAMPLES

The non-limiting examples below illustrate compositions according to the present disclosure.

Examples 1A-1F

Liquid Detergent Fabric Care Compositions: Liquid detergent fabric care compositions are made by mixing together the ingredients listed in the proportions shown in Table 1.

TABLE 1

| Ingredient (wt %) | 1A | 1B | 1C | 1D | 1E | 1F |
|---|---|---|---|---|---|---|
| $C_{12}$-$C_{15}$ alkyl polyethoxylate (1.8) sulfate[1] | 4.06 | 8.03 | 4.06 | 4.06 | 7.42 | 11.3 |
| $C_{11.8}$ linear alkylbenzene sulfonc acid[2] | 4.06 | 8.03 | 4.06 | 4.06 | 4.24 | — |
| $C_{12}$-$C_{14}$ alcohol 9 ethoxylate[3] | 4.0 | 8.03 | 4.0 | 4.0 | 7.42 | 11.3 |
| $C_{12}$ alkyl dimethyl amine oxide[4] | — | 1.00 | — | — | — | — |
| $C_{12}$-$C_{18}$ Fatty Acid[4] | — | — | — | — | 1.12 | 1.12 |
| Ratio of anionic surfactant:nonionic surfactant | 2:1 | 1.8:1 | 2:1 | 2:1 | 1.7:1 | 1.1:1 |
| 1,2 Propane diol[5] | 1.52 | 1.93 | 1.52 | 1.52 | 2.00 | 2.00 |
| Diethylene glycol | 1.21 | 1.61 | 1.21 | 1.21 | 1.33 | 1.33 |
| Ethanol | 0.79 | 1.19 | 0.79 | 0.79 | 0.98 | 0.98 |
| Na Cumene Sulfonate | 1.12 | — | 1.12 | 1.12 | 1.50 | 1.50 |
| Citric acid | 1.16 | 2.41 | 2.41 | 2.41 | 2.71 | 2.71 |
| Sodium tetraborate | 1.57 | 2.10 | 2.10 | 2.10 | 2.10 | 2.10 |
| Protease[6] (51.4 mg/g) | | 0.23 | 1.05 | 1.05 | 1.05 | 1.05 |
| Amylase[7] (13.34 mg/g) | | 0.04 | 0.20 | 0.20 | 0.20 | 0.20 |
| Fluorescent Whitening Agent[8] | 0.05 | 0.11 | 0.05 | 0.05 | 0.05 | 0.05 |
| Hueing Agent[9] | — | 0.046 | 0.02 | 0.02 | — | 0.05 |
| Diethylenetriamine pentaacetic acid[5] | 0.32 | 0.66 | 0.32 | 0.32 | 0.32 | 0.32 |
| Cleaning Polymers[10, 11, 12] | 2.00 | 2.00 | 2.00 | 2.00 | 2.00 | 2.00 |
| Hydrogenated castor oil[13] | 0.15 | 0.20 | 0.20 | 0.20 | 0.20 | 0.20 |
| Cationic Copolymer | 0.19[14] | 0.20[14] | 0.15[17] | 0.15[18] | 0.15[19] | 0.15[20] |
| Perfume Microcapsules[15] | 0.19 | 0.26 | 0.46 | 0.26 | 0.26 | — |
| Organosiloxane polymer[16] | 4.0 | 4.0 | 3.5 | 4.0 | 4.0 | 2.0 |
| Water, perfumes, dyes, buffers, solvents and other optional components | to 100%; pH 8.0-8.2 | to 100%; pH 8.0-8.2 | to 100%; pH 8.0-8.2 | to 100%; pH 8.0-8.2 | to 100%; pH 8.0-8.2 | to 100%; pH 8.0-8.2 |

Examples 2A-F

Liquid or Gel Detergents: Liquid or gel detergent fabric care compositions are prepared by mixing the ingredients listed in the proportions shown in Table 2.

TABLE 2

| Ingredient (wt %) | 2A | 2B | 2C | 2D | 2E | 2F |
|---|---|---|---|---|---|---|
| $C_{12}$-$C_{15}$ alkyl polyethoxylate (3.0) sulfate[1] | 6.83 | 6.83 | 6.83 | 6.83 | 6.83 | 6.83 |
| $C_{11.8}$ linear alkylbenzene sulfonic acid[2] | 3.14 | 3.14 | 3.14 | 3.14 | 3.14 | 3.14 |
| $C_{14}$-$C_{15}$ alkyl 7-ethoxylate[1] | 2.80 | 2.80 | 2.80 | 2.80 | 2.80 | 2.80 |
| $C_{12}$-$C_{14}$ alkyl 7-ethoxylate[3] | 0.93 | 0.93 | 0.93 | 0.93 | 0.93 | 0.93 |
| $C_{12}$-$C_{18}$ Fatty Acid[4] | 4.08 | 4.08 | 4.08 | 4.08 | 4.08 | 4.08 |
| Ratio of anionic surfactant:nonionic surfactant | 3.8:1 | 3.8:1 | 3.8:1 | 3.8:1 | 3.8:1 | 3.8:1 |
| 1,2 Propane diol[5] | 4.83 | 4.83 | 4.83 | 4.83 | 4.83 | 4.83 |
| Ethanol | 0.95 | 0.95 | 0.95 | 0.95 | 0.95 | 0.95 |

TABLE 2-continued

| Ingredient (wt %) | 2A | 2B | 2C | 2D | 2E | 2F |
|---|---|---|---|---|---|---|
| Sorbitol | 0.03 | 0.03 | 0.03 | 0.03 | 0.03 | 0.03 |
| Citric acid | 3.19 | 3.19 | 3.19 | 3.19 | 3.19 | 3.19 |
| HA FNA-Base (54.5 mg/g/)[6] | 0.39 | 0.39 | 0.39 | 0.39 | 0.39 | 0.39 |
| Natalase 200L (29.26 mg/g)[7] | 0.093 | 0.093 | 0.093 | 0.093 | 0.093 | 0.093 |
| Termamyl Ultra (25.1 mg/g)[7] | 0.046 | 0.046 | 0.046 | 0.046 | 0.046 | 0.046 |
| Protease[6] | — | — | — | — | — | 0.60 |
| Amylase[7] | — | — | — | — | — | 0.19 |
| Fluorescent Whitening Agent[8] | — | — | — | — | — | 0.02 |
| Hydroxy Ethylidene 1,1 Di Phosphonic acid | 0.22 | 0.22 | 0.22 | 0.22 | 0.22 | 0.22 |
| Zwitterionic ethoxylated quaternized sulfated hexamethylene diamine[12] | 0.31 | 0.31 | 0.31 | 0.31 | 0.31 | 0.31 |
| Hydrogenated castor oil[13] | 0.20 | 0.20 | 0.20 | 0.20 | 0.20 | 0.20 |
| Cationic Copolymer | 0.15[14] | 0.15[17] | 0.15[18] | 0.15[19] | 0.15[20] | 0.15[18] |
| Perfume microcapsule[15] | — | — | — | — | — | 0.42 |
| Organosiloxane polymer[16] | 3.00 | 3.00 | 3.00 | 3.00 | 3.00 | 3.00 |
| Water, perfumes, dyes, buffers, neutralizers, stabilizers and other optional components | to 100%; pH 8.0-8.2 | to 100%; pH 8.0-8.2 | to 100%; pH 8.0-8.2 | to 100%; pH 8.0-8.2 | to 100%; pH 8.0-8.2 | to 100%; pH 8.0-8.2 |

Example 3A-E

Unit Dose Detergents. Liquid or gel detergents that can be in the form of soluble mono- or multi-compartment unit dose (e.g., liquid detergent surrounded by a polyvinylalcohol film, such as M8630, available from MonoSol, LLC (Merrillville, Ind., USA), or films according to those disclosed in US Patent Application 2011/0188784A1) are prepared by mixing the ingredients listed in the proportions shown in Table 3.

TABLE 3

| Ingredient (wt %) | 3A | 3B | 3C | 3D | 3E |
|---|---|---|---|---|---|
| $C_{12}$-$C_{15}$ alkyl polyethoxylate (3.0) sulfate[1] | 8.8 | 8.8 | 5.6 | 13.7 | 10.5 |
| $C_{11.8}$ linear alkylbenzene sulfonic acid[2] | 18.6 | 18.6 | 18.2 | 13.7 | 18.6 |
| $C_{14}$-$C_{15}$ alkyl 7-ethoxylate[1] or $C_{12}$-$C_{14}$ alkyl 7-ethoxylate[3] (or mixtures thereof) | 14.5 | 14.5 | 13.6 | 14.5 | 8.8 |
| $C_{12}$-$C_{18}$ Fatty Acid[4] | 6.1 | — | 11.0 | — | 5.0 |
| Ratio of anionic surfactant:nonionic surfactant | 2.3:1 | 1.8:1 | 2.5:1 | 2:1 | 4:1 |
| 1,2 Propane diol[5] | 14.0 | 17.0 | 15.7 | 17.0 | 15.7 |
| Glycerol | 4.0 | 4.9 | 4.9 | 4.9 | 4.9 |
| Di propylene Glycol | 0.07 | 0.07 | 0.07 | 0.07 | 0.07 |
| Citric acid | 0.7 | 0.7 | 0.7 | 0.7 | 0.7 |
| Enzymes (mixtures of Protease[6] and (amylase, lipase, mannanase, xyloglucanase)[7] | 0.1 | 0.05 | 0.05 | 0.05 | 0.05 |
| Fluorescent Whitening Agent[8] | 0.3 | 0.3 | 0.3 | 0.3 | 0.3 |
| Hueing Agent | 0.03 | — | — | — | — |
| Hydroxy Ethylidene 1,1 Di Phosphonic acid | 2.1 | 0.8 | 0.8 | 0.8 | 0.8 |
| Cleaning Polymers[10, 11, 12] | 6.9 | 3.2 | 3.2 | 3.2 | 3.2 |
| Hydrogenated castor oil[13] | 0.13 | 0.15 | 0.15 | 0.15 | 0.15 |
| Cationic Copolymer[14] | 0.20 | — | 0.40 | 0.40 | 0.40 |
| Cationic Terpolymer[20] | — | 0.40 | — | — | — |
| Perfume microcapsule[15] | — | 0.63 | 0.63 | 0.63 | 0.63 |
| Organosiloxane polymer | 3.0[16] | 6.0[16] | 4.0[16] | 6.0[16] | 6.0[21] |
| Water, perfumes, dyes, buffers, neutralizers, stabilizers and other optional components | to 100%; pH 7.0-8.5 | to 100%; pH 7.0-8.5 | to 100%; pH 7.0-8.5 | to 100%; pH 7.0-8.5 | to 100%; pH 7.0-8.5 |

Ingredient Key for Tables 1, 2, and 3:

[1] Available from Shell Chemicals, Houston, Tex.

[2] Available from Huntsman Chemicals, Salt Lake City, Utah

[3] Available from Sasol Chemicals, Johannesburg, South Africa

[4] Available from The Procter & Gamble Company, Cincinnati, Ohio

[5] Available from Sigma Aldrich chemicals, Milwaukee, Wis.

[6] Available from DuPont-Genencor, Palo Alto, Calif.

[7] Available from Novozymes, Copenhagen, Denmark

[8] Available from Ciba Specialty Chemicals, High Point, N.C.

[9] Available from Milliken Chemical, Spartanburg, S.C.

[10] 600 g/mol molecular weight polyethylenimine core with 20 ethoxylate groups per —NH and obtained from BASF (Ludwigshafen, Germany)

[11] 600 g/mol molecular weight polyethylenimine core with 24 ethoxylate groups per —NH and 16 propoxylate groups per —NH. Obtained from BASF (Ludwigshafen, Germany)

[12] Described in WO 01/05874 and obtained from BASF (Ludwigshafen, Germany)

[13] Available under the tradename Thixin® from Elementis Specialties, Highstown, N.J.

[14] Copolymer of a mol ratio of 16% acrylamide and 84% diallyldimethylammonium chloride with a weight-average molecular weight of 47 kDa obtained from BASF, Ludwigshafen, Germany

[15] Available from Appleton Paper of Appleton, Wis.

[16] Magnasoft Plus, available from Momentive Performance Materials, Waterford, N.Y.

[17] Cationic terpolymer of a mol ratio of 15.7% acrylamide, 80.0% diallyldimethylammonium chloride, and 4.3% acrylic acid with a weight-average molecular weight of 48 kDa obtained from BASF, Ludwigshafen, Germany

[18] Cationic copolymer of a mol ratio of 16% acrylamide and 84% methacrylamidopropyl trimethylammonium chloride with a weight-average molecular weight of 79 kDa obtained from BASF, Ludwigshafen, Germany

[19] Cationic copolymer of a mol ratio of 16% acrylamide and 84% acrylamidopropyl trimethylammonium chloride with a weight-average molecular weight of 160 kDa obtained from BASF, Ludwigshafen, Germany

[20] Cationic copolymer of a mol ratio of 16% acrylamide and 84% quaternized vinylimidazole chloride (QVI) with a weight-average molecular weight of 66 kDa obtained from BASF, Ludwigshafen, Germany

[21] Siloxane polymer PDMS, DC349, available from Dow-Corning, Midland, Mich.

Example 4A-F

Rinse-Added Fabric Softener compositions. Fabric softener compositions are made by mixing together the ingredients listed in the proportions shown in Table 4.

TABLE 4

| Ingredient (% wt) | 4A | 4B | 4C | 4D | 4E | 4F |
|---|---|---|---|---|---|---|
| FSA[a] | 15 | 5 | 12.25 | 17 | 12.00 | 11.00 |
| Isopropyl Alcohol | — | 0.5 | 1.25 | — | — | — |
| Ethanol | 1.53 | — | — | 1.75 | — | — |
| Coconut Oil | 0.51 | 0.17 | 0.42 | 0.58 | — | — |
| Silicone[b] | 1.00[b] | — | — | 1.00[b] | 3.00[b] | 3.00[c] |
| Thickening Agent[d] | 0.25 | 0.26 | 0.15 | — | 0.15 | 0.10 |
| Perfume | 1.5 | 0.9 | 2.4 | 1.25 | 2.0 | 2.0 |
| Perfume | 0.55 | 0.10 | 0.55 | 0.5 | 0.35 | 0.25 |
| Micro-Capsules[e] | — | — | — | — | — | — |
| Calcium Chloride | 0.10 | — | — | 0.19 | 0.10 | 0.10 |
| DTPA[f] | 0.05 | 0.05 | 0.05 | 0.008 | 0.05 | 0.05 |
| HCl | 0.030 | 0.02 | 0.010 | 0.010 | 0.02 | 0.02 |
| Formic Acid | 0.025 | — | 0.025 | — | 0.025 | 0.025 |
| Preservative, anti-foam, dye, other optional ingredients, Deionized Water | Balance | Balance | Balance | Balance | Balance | Balance |

[a]Fabric Softening Active N,N-bis(ditallowyl)-N,N-dimethylammonium chloride.

[b]Polydimethylsiloxane emulsion from Dow Corning ® under the trade name DC346 available from Dow Corning.

[c]Aminofunctional silicone.

[d]Rheovis CDE ex BASF.

[e]Perfume microcapsules available ex Appleton

[f]Diethylenetriaminepentaacetic acid.

Example 5. Rinse-Added Softener Composition Improves Deposition of Detergent-Sourced Silicone Examples 5A and 5B demonstrate the effect of increased silicone deposition on cotton terry towels in a multi-cycle regimen test according to the Silicone Deposition Test Method given above. The fabrics are treated with a 65 g of a detergent according to Formula 1B (anionic:non-ionic ratio=1.8:1), followed by a 89 g of a rinse added composition of Formula 4B or a clear rinse (e.g., water only; no softener composition added during the rinse cycle) in North American top-loading machines (water hardness=3 gpg), as noted in Table 5.

TABLE 5

| Example | Detergent Composition (comprising silicone) | Softener Composition (silicone-free) | Silicone Deposition on Fabric (ug/g) | Silicone Deposition Index (%) |
|---|---|---|---|---|
| 5A | 1B | 4B | 330 | 10.7% |
| 5B (comp) | 1B | None added | 160 | 5.2% |

Fabrics treated with the regimen of a detergent composition 1B comprising silicone and cationic polymer and a rinse-added fabric softener composition 4B that does not comprise silicone according to Example 5A has 2 times more silicone deposition than fabrics treated with a detergent composition 1B comprising silicone and cationic polymer without any rinse-added fabric softener according to Example 5B.

Example 6. Silicone Deposition Improved with Use of Both Detergent and Softener Compositions Examples 6A-6C demonstrate the effect of increased silicone deposition on cotton terry towels in a multi-cycle regimen test according to the Silicone Deposition Test Method given above. The fabrics are treated with a 50 g of a detergent according to Formula 1A (anionic:non-ionic ratio=2:1), followed by 25.5 g of a rinse added (softener) composition of Formula 4A or a clear rinse (i.e., no softener composition added) in North American top-loading machines (water hardness=7 gpg), as noted in Table 6.

TABLE 6

| Example | Detergent Composition | Softener Composition (comprising silicone) | Silicone Deposition on Fabric (ug/g) |
|---|---|---|---|
| 6A (comparative) | 1A | None added | 220 |
| 6B (comparative) | 1A (without silicone or cationic polymer) | 4A | 100 |
| 6C | 1A | 4A | 480 |

Fabrics treated with the regimen of a detergent composition 1A comprising silicone and cationic polymer and a rinse-added fabric softener composition 4A also comprising silicone according to Example 6C have more silicone deposition than fabrics treated with a detergent composition 1A comprising silicone and cationic polymer according to Example 6A or fabrics treated with a detergent composition 1A without any silicone or cationic polymer and a rinse-added fabric softener composition 4A according to Example 6B. Significantly, Example 6C shows that the silicone deposition resulting from 1A and 4A used together is approximately 1.5 greater than sum of the silicone deposition resulting from 1A and 4A individually.

Example 7. Consumer Preference

Examples 7A and 7B demonstrate the improved preference for the regimen treatments on cotton terry towels in a 3-cycle regimen test according to the North American top-loading Fabric Preparation Method given above (water hardness=7 gpg). The fabrics are treated with 50 g of a detergent according to Formula 1A (anionic:non-ionic ratio=2:1), followed by 25.5 g of a rinse added composition of Formula 4A, as noted in Table 7.

TABLE 7

| Example | Detergent Composition | Softener Composition | Preference (%) |
|---|---|---|---|
| 7A | 1A | 4A | 79 |
| 7B (comparative) | 1A without silicone or cationic polymer | 4A | 21 |

Fabrics (100% cotton terry towels) that are treated with 3 cycles of the regimen of 1A through the wash with 4A through the rinse are evaluated in a paired comparison by 35 consumers. Of the 35 consumers, 33 (94%) could detect a difference in the treatments. Of those consumers that could detect a difference, 79% preferred the regimen treatment 7A, further demonstrating softening benefit of the wash- and rinse regimen of the present disclosure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of treating a fabric, said method comprising:

a. a washing step, wherein said washing step comprises contacting said fabric with an effective amount of a detergent composition, thereby forming a washed fabric, wherein said detergent composition comprises:

i) a surfactant system comprising an anionic surfactant and a nonionic surfactant in a weight ratio of from about 1.1:1 to about 4:1, and wherein said anionic surfactant comprises a linear alkylbenzene sulphonate (LAS) and alkyl ethoxylated sulfate (AES) in a weight ratio of about 0.5:1 to about 1.5:1;

ii) a cationic polymer, and iii) a silicone, followed by b. a rinsing step, wherein said washed fabric is contacted with an effective amount of a softener composition, thereby forming a treated fabric, wherein said softener composition comprises a fabric softening active selected from the group consisting of a quaternary ammonium compound, silicone, fatty acids or esters, sugars, fatty alcohols, alkoxylated fatty alcohols, polygvcerol esters, oily sugar derivatives, wax emulsions, fatty acid glycerides, or mixtures thereof.

2. A method according to claim 1, wherein said washing step comprises contacting said fabric with said detergent composition in the presence of water, wherein the detergent composition and the water form a wash liquor.

3. A method according to claim 2, wherein said wash liquor is substantially removed from said washed fabric before said rinsing step occurs.

4. A method according to claim 1, wherein said rinsing step comprises contacting said fabric with said softener composition in the presence of water, wherein the softener composition and the water form a rinse liquor.

5. A method according to claim 1, wherein said weight ratio of anionic surfactant to nonionic surfactant is from about 1.5:1 to about 2.5:1.

6. A method according to claim 1, wherein said weight ratio of anionic surfactant to nonionic surfactant is about 2:1.

7. A method according to claim 1, wherein said cationic polymer is characterized by a weight average molecular weight of from about 5 kDaltons to about 200 kDaltons.

8. A method according to claim 7, wherein said cationic polymer comprises a first structural unit derived from acrylamide, wherein said cationic deposition polymer further comprises a second structural unit derived from DADMAC, and wherein said first structural unit and said second structural unit are in a structural unit ratio of from about 5:95 to about 45:55.

9. A method according to claim 1, wherein said fabric softening active comprises a quaternary ammonium compound selected from the group consisting of:

a) linear quaternary ammonium compounds b) branched quaternary ammonium compounds c) cyclic quaternary ammonium compounds d) and mixtures thereof;

said quaternary ammonium compounds comprising:

one or more $C_{10}$-$C_{22}$ fatty acid moieties, $C_{16}$-$C_{20}$ fatty acid moieties, or $C_{16}$-$C_{18}$ fatty acid moieties, said fatty acid moieties having an Iodine value from 0 to about 95;

a counter ion; and one or more moieties selected from the group consisting of alkyl moieties, ester moieties, amide moieties, and ether moieties said one or more moieties being covalently bound to the nitrogen of said quaternary ammonium compound.

10. A method according to claim 9, wherein said fabric softening active further comprises a silicone selected from the group consisting of polydimethylsiloxane (PDMS), aminosilicone, silicone polyether, cationic silicones, silicone polyurethane, silicone polyureas, or mixtures thereof.

11. A method according to claim 1, wherein said detergent composition and/or said fabric softener composition further comprises a perfume microcapsule.

12. A method according to claim 1, wherein said rinsing step results in Silicone Deposition on the treated fabric of from about 80 ug silicone/g to about 5000 ug silicone/g according to the method described herein.

13. A method according to claim 1, wherein said rinsing step results in a Silicone Deposition Index on the treated fabric of from about 4% to about 75%.

14. A method according to claim 1, wherein said anionic surfactant comprises fatty acids and salts thereof.

15. A method according to claim 1, wherein said detergent composition is encapsulated in a pouch, wherein said pouch comprises a water-soluble film.

16. A multi-component fabric treatment system, wherein the system comprises a first component comprising a detergent composition as described in claim 1, and where the system further comprises a second component comprising a softener composition as described in claim 1.

17. A multi-component fabric treatment system according to claim 16, wherein the first component comprises a first container and the second component comprises a second container.

18. A multi-component fabric treatment system according to claim 16, wherein the first component comprises a water-soluble pouch.

19. A multi-component fabric treatment system according to claim 16, wherein the first component and the second component are proximal to each other on a shelf or in a display.

20. A multi-component fabric treatment system according to claim 19, wherein the first and second components are separated by no more than about 100 centimeters.

* * * * *